US011705259B2

(12) United States Patent
Koeda et al.

(10) Patent No.: US 11,705,259 B2
(45) Date of Patent: Jul. 18, 2023

(54) SOFT MAGNETIC METAL POWDER, DUST CORE, AND MAGNETIC COMPONENT

(71) Applicant: TDK CORPORATION, Tokyo (JP)

(72) Inventors: Masahito Koeda, Tokyo (JP); Kazuhiro Yoshidome, Tokyo (JP); Hiroyuki Matsumoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 114 days.

(21) Appl. No.: 17/036,447

(22) Filed: Sep. 29, 2020

(65) Prior Publication Data

US 2021/0098164 A1 Apr. 1, 2021

(30) Foreign Application Priority Data

Sep. 30, 2019 (JP) ..... 2019-180943
Jul. 30, 2020 (JP) ..... 2020-129377

(51) Int. Cl.
*H01F 3/08* (2006.01)
*H01F 1/153* (2006.01)
*H01F 1/24* (2006.01)

(52) U.S. Cl.
CPC ..... *H01F 3/08* (2013.01); *H01F 1/15333* (2013.01); *H01F 1/24* (2013.01)

(58) Field of Classification Search
None
See application file for complete search history.

(56) References Cited

U.S. PATENT DOCUMENTS

2018/0025822 A1* 1/2018 Yonezawa ..... C22C 38/001 428/551
2019/0156975 A1* 5/2019 Urata ..... H01F 27/255
2019/0279796 A1 9/2019 Hosono et al.

FOREIGN PATENT DOCUMENTS

JP 2007-92120 A 4/2007
JP 2010-138439 A 6/2010
JP 2015-132010 A 7/2015
JP 2019-157187 A 9/2019
JP 2020-155669 A 9/2020
JP 2020-155674 A 9/2020

* cited by examiner

*Primary Examiner* — Kevin M Bernatz
(74) *Attorney, Agent, or Firm* — Oliff PLC

(57) ABSTRACT

According to an aspect, a soft magnetic metal powder includes a plurality of soft magnetic metal particles containing iron, a surface of each of the soft magnetic metal particles is covered with a coating part, and a maximum height Sz of a surface of the coating part is 10 to 700 nm. According to another aspect, a soft magnetic metal powder includes a plurality of soft magnetic metal particles containing iron, a surface of each of the soft magnetic metal particles is covered with a coating part, and a maximum height Rz of a surface of the coating part is 10 to 700 nm.

18 Claims, 3 Drawing Sheets

SOFT MAGNETIC METAL POWDER, DUST CORE, AND MAGNETIC COMPONENT

BACKGROUND OF THE INVENTION

1. Field of the Invention

The present invention relates to a soft magnetic metal powder, a dust core, and a magnetic component.

2. Description of the Related Art

As a magnetic component that is used in a power supply circuit of various electronic devices, a transformer, a choke coil, an inductor, and the like are known.

Such a magnetic component has a configuration in which a coil (winding) that is an electric conductor is disposed at the periphery or the inside of a magnetic core (core) exhibiting predetermined magnetic characteristics.

Examples of a magnetic material that is used in the magnetic core provided in the magnetic component such as the inductor include a soft magnetic metal material containing iron (Fe). For example, the magnetic core can be obtained as a dust core by compression-molding a soft magnetic metal powder including particles constituted by the soft magnetic metal containing Fe.

In the dust core, a ratio (filling ratio) of a magnetic component is increased to improve magnetic characteristics. To increase the ratio (filling ratio) of the magnetic component, a method of decreasing the amount of an insulating resin contained is employed. However, in the method, a contact ratio between soft magnetic metal particles increases, and a loss caused by a current (inter-particle eddy current) flowing between particles which are in contact with each other increases at the time of AC voltage application to the magnetic component. As a result, there is a problem that a core loss of the dust core becomes large.

Here, in order to suppress the eddy current, an insulating coating film is formed on a surface of the soft magnetic metal particles. For example, JP 2015-132010 A discloses a method for forming an insulating coating layer, in which a powder glass containing oxides of phosphorus (P) softened by mechanical friction is adhered to the surface of an Fe-based amorphous alloy powder.

In JP 2015-132010 A, the Fe-based amorphous alloy powder on which the insulating coating layer is formed is mixed with a resin to form a dust core by compression molding. In the dust core, when mechanical strength of the core is low, a crack is likely to occur, and problems such as a decrease in permeability, and a decrease in inductance occur. Accordingly, in addition to satisfactory magnetic characteristics and a high insulating property (withstand voltage property), high mechanical strength is required for the dust core. However, when the insulating coating layer is simply formed by the method disclosed in JP 2015-132010 A, the withstand voltage property and the strength cannot be compatible with each other.

BRIEF SUMMARY OF THE INVENTION

The invention has been made in consideration such circumstances, and an object thereof is to provide a dust core having satisfactory withstand voltage properties and strength, a magnetic component including the dust core, and a soft magnetic metal powder suitable for the dust core.

The present inventors found that when a coating part having a predetermined surface texture is provided on soft magnetic metal particles of a soft magnetic metal having a specific composition, both the withstand voltage property and the strength of the dust core are improved. Based on the founding, the present invention has been accomplished.

That is, aspects of the invention are as follows.

[1] A soft magnetic metal powder including soft magnetic metal particles containing iron, in which a surface of each of the soft magnetic metal particles is covered with a coating part, and a maximum height Sz of a surface of the coating part is 10 to 700 nm.

[2] The soft magnetic metal powder according to [1], in which an arithmetical mean height Sa of the surface of the coating part may be 3 to 50 nm.

[3] The soft magnetic metal powder according to [1] or [2], in which Sz/T may be 1.5 to 30 when a thickness of the coating part is set as T [nm].

[4] A soft magnetic metal powder including soft magnetic metal particles containing iron, in which a surface of each of the soft magnetic metal particles is covered with a coating part, and a maximum height Rz of a surface of the coating part is 10 to 700 nm.

[5] The soft magnetic metal powder according to [4], in which, an arithmetical mean height Ra of the surface of the coating part may be 3 to 100 nm.

[6] The soft magnetic metal powder according to [4] or [5], in which Rz/T may be 1.5 to 30 when a thickness of the coating part is set as T [nm].

[7] The soft magnetic metal powder according to any one of [1] to [6], in which T may be 3 to 200 nm when a thickness of the coating part is set as T [nm].

[8] The soft magnetic metal powder according to any one of [1] to [7], in which, the coating part may contain at least one selected from the group consisting of phosphorus, aluminum, calcium, barium, bismuth, silicon, chromium, sodium, zinc, and oxygen.

[9] The soft magnetic metal powder according to any one of [1] to [8], in which, the soft magnetic metal particles may be constituted by an amorphous alloy.

[10] The soft magnetic metal powder according to any one of [1] to [8], in which, the soft magnetic metal particles may be constituted by a nanocrystalline alloy.

[11] A dust core containing the soft magnetic metal powder according to any one of [1] to [10].

[12] A magnetic component including the dust core according to [11].

According to the present invention, a dust core having satisfactory withstand voltage properties and strength, a magnetic component including the dust core, and a soft magnetic metal powder suitable for the dust core are provided.

DETAILED DESCRIPTION OF THE INVENTION

Figure 1:
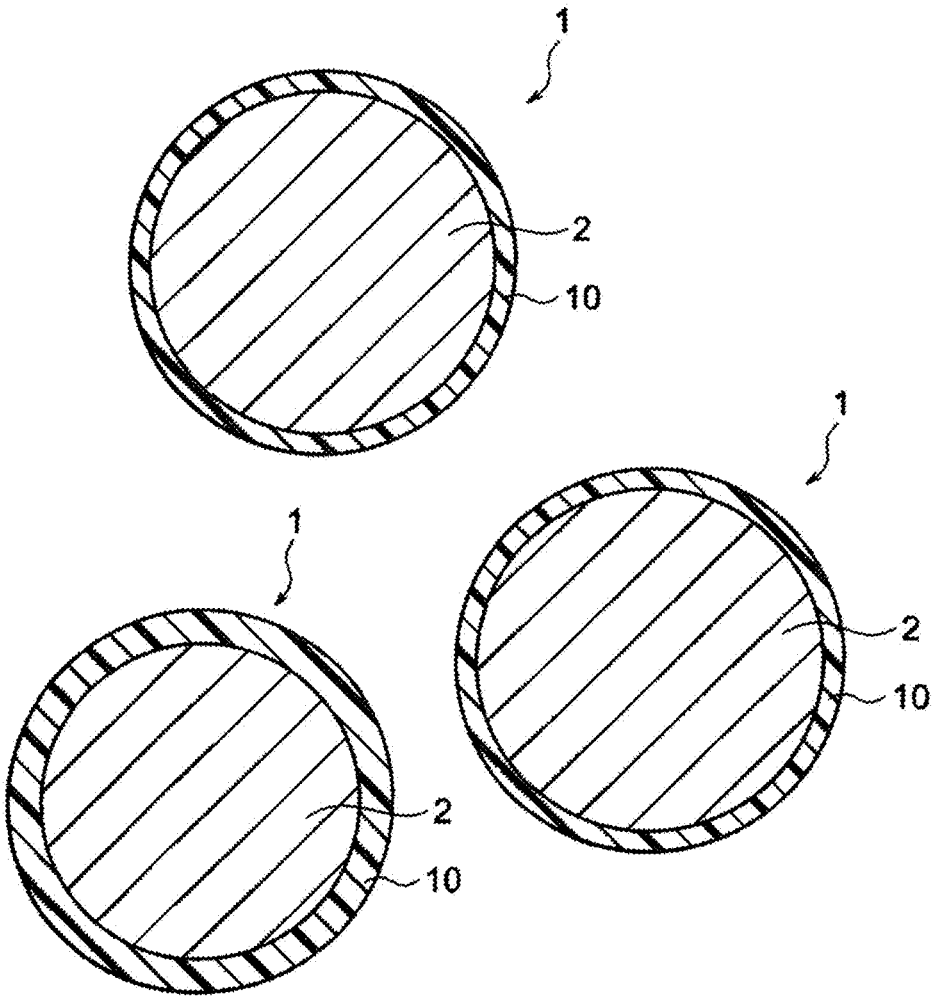
FIG. 1 is a cross-sectional schematic view of coated particles which constitute a soft magnetic metal powder according to an embodiment.

Since compatibility between the strength and the withstand voltage of the dust core was difficult in the related art, the present inventors have made a thorough investigation on a correlation between a nano-level fine structure of soft magnetic particle surface on which a coating part is formed, and the strength and the withstand voltage of the dust core from a new viewpoint.

The present inventors have made a thorough investigation on a correlation between nano-level surface roughness of the soft magnetic particle surface on which the coating part is formed and the strength of the dust core among many complex strength factors having an influence on the dust core.

As a result, they found that when surface roughness of the soft magnetic particles on which the coating part is formed is equal to or greater than a lower limit value of a range described in the appended claims, it is effective to improve the strength of the dust core.

In addition, with regard to the withstand voltage of the dust core, the present inventors have made a thorough investigation on a correlation between the nano-level surface roughness of the soft magnetic particle surface on which the coating part is formed and the withstand voltage among many complex withstand voltage factors having an influence on the dust core.

As a result, they found that when the surface roughness of the soft magnetic particles on which the coating part is formed is equal to or lower than an upper limit value of a range described in the appended claims, it is effective for an improvement of that withstand voltage of the dust core. They also found that the surface roughness of the soft magnetic particles on which the coating part is formed is within a range described in the appended claims, compatibility of the strength of the dust core and the withstand voltage, which is difficult in the related art, can be realized at a high level.

Hereinafter, the invention will be described in detail in the following order on the basis of specific embodiments illustrated in the drawings.

1. Soft Magnetic Metal Powder
1.1. Soft Magnetic Metal
  1.1.1. Fe-Based Amorphous Alloy
  1.1.2. Fe-Based Nanocrystalline Alloy
1.2. Coating Part
  1.2.1. Composition
  1.2.2. Surface Texture
2. Dust Core
3. Magnetic Component
4. Method for Manufacturing Dust Core
4.1. Method for Manufacturing Soft Magnetic Metal Powder
4.2. Method for Manufacturing Dust Core (1. Soft Magnetic Metal Powder)

As illustrated in FIG. 1, a soft magnetic metal powder according an embodiment includes a plurality of coated particles 1 in which a coating part 10 is formed on a surface of a soft magnetic metal particle 2. When a number ratio of particles included in the soft magnetic metal powder is set as 100%, a number ratio of the coated particles is preferably 90% or greater, and more preferably 95% or greater.

In this embodiment, a shape of the soft magnetic metal particle 2 is preferably spherical. Specifically, the average circularity of a cross-section of the soft magnetic metal particle 2 included in the soft magnetic metal powder is preferably 0.85 or greater. As the circularity, for example, Wadell's circularity can be used.

In addition, an average particle size (D50) of the soft magnetic metal powder according to this embodiment may be selected depending on an application and a material. In this embodiment, the average particle size (D50) is preferably within a range of 0.3 to 100 μm. When the average particle size of the soft magnetic metal powder is set within the above-described range, it is easy to maintain sufficient moldability or predetermined magnetic characteristics. A method for measuring the average particle size is not particularly limited, but it is preferable to use a laser diffraction scattering method.

In this embodiment, the soft magnetic metal powder may include only soft magnetic metal particles of the same material, or soft magnetic metal particles of different materials. Here, examples of the different materials include a case where elements constituting the soft magnetic metal are different from each other, a case where compositions are different in the same constituent elements.

(1.1. Soft Magnetic Metal)

The soft magnetic metal particle is constituted by a soft magnetic metal containing iron (Fe). Examples of the soft magnetic metal containing iron include a pure iron, a Fe-based alloy, a Fe—Si-based alloy, a Fe—Al-based alloy, a Fe—Ni-based alloy, a Fe—Si—Al-based alloy, a Fe—Si—Cr-based alloy, and a Fe—Ni—Si—Co-based alloy; Fe-based amorphous alloys; Fe-based nanocrystalline alloys; and the like.

The Fe-based amorphous alloy may be constituted by only an amorphous phase, or may have a structure in which initial fine crystals are dispersed in the amorphous phase, that is, a nano-heterostructure.

The Fe-based nanocrytsalline alloy has a structure in which nanometer-scale Fe-based nanocrystals are dispersed in an amorphous phase.

In this embodiment, as the soft magnetic metal containing iron, a Fe-based amorphous alloy, or a Fe-based nanocrystalline alloy is preferable. Hereinafter, description will be given of the Fe-based amorphous alloy and the Fe-based nanocrystalline alloy.

(1.1.1. Fe-Based Amorphous Alloy)

In this embodiment, it is preferable that the Fe-based amorphous alloy has a nano-heterostructure in which initial fine crystals exist in the amorphous phase. This structure is a structure obtained by rapidly cooling a molten metal of a raw material of the soft magnetic metal, and is a structure in which a number of fine crystals precipitate into an amorphous alloy and disperse. Accordingly, an average crystal grain size of the initial fine crystals is very small. In this embodiment, the average crystal grain size of the initial fine crystals is preferably 0.3 to 10 nm.

When the soft magnetic metal having the nano-heterostructure is subjected to a heat treatment under predetermined conditions, initial fine crystals grow, and thus it is easy to obtain a Fe-based nanocrystalline alloy to be described later.

Next, a composition of the Fe-based amorphous alloy will be described in detail.

In this embodiment, the composition of the Fe-based amorphous alloy is preferably expressed by a composition formula $(Fe_{(1-(\alpha+\beta))}X1_{\alpha}X2_{\beta})_{(1-(a+b+c+d+e+f))}M_aB_bP_cSi_dC_eS_f$.

In the composition formula, M represents at least one of element selected from the group consisting of niobium (Nb), hafnium (Hf), zirconium (Zr), tantalum (Ta), molybdenum (Mo), tungsten (W), titanium (Ti), and vanadium (V).

In addition, "a" represents a molar ratio of M, and it is preferable that "a" satisfies a relationship of $0 \leq a \leq 0.300$ from the viewpoint of the withstand voltage property and the strength of the dust core. That is, the soft magnetic metal may not contain M.

Furthermore, in addition to the viewpoint of the withstand voltage property and the strength of the dust core, from the viewpoint of soft magnetic characteristics, it is preferable that "a" satisfies a relationship of $0 \leq a \leq 0.150$. The molar ratio (a) of M is more preferably 0.040 or greater, and still more preferably 0.050 or greater. In addition, the molar ratio (a) of M is more preferably 0.100 or less, and still more preferably 0.080 or less. In a case where "a" is excessively large, there is a tendency that saturation magnetization of the powder is likely to decrease.

In the composition formula, "b" represents a molar ratio of boron (B), and from the viewpoint of the withstand voltage property and the strength of the dust core, it is preferable that "b" satisfies a relationship of $0 \leq b \leq 0.400$. That is, the soft magnetic metal may not contain B.

Furthermore, in addition to the viewpoint of the withstand voltage property and the strength of the dust core, from the viewpoint of the soft magnetic characteristics, it is preferable that "b" satisfies a relationship of $0 \leq b \leq 0.200$. The molar ratio (b) of B is more preferably 0.025 or greater, still more preferably 0.060 or greater, and still more preferably 0.080 or greater. In addition, the molar ratio (b) of B is more preferably 0.150 or less, and still more preferably 0.120 or less. In a case where "b" is excessively large, there is a tendency that saturation magnetization of the powder is likely to decrease.

In the composition formula, "c" represents a molar ratio of phosphorous (P), and from the viewpoint of the withstand voltage property and the strength of the dust core, it is preferable that "c" satisfies a relationship of $0 \leq c \leq 0.400$. That is, the soft magnetic metal may not contain P.

In addition, in addition to the viewpoint of the withstand voltage property and the strength of the dust core, from the viewpoint of the soft magnetic characteristics, it is preferable that "c" satisfies a relationship of $0 \leq c \leq 0.200$. The molar ratio (c) of P is more preferably 0.005 or greater, and still more preferably 0.010 or greater. In addition, the molar ratio (c) of P is more preferably 0.100 or less. In a case where "c" is within the above-described range, resistivity of the soft magnetic metal is improved, and a coercive force thereof tends to decrease. In a case where "c" is excessively large, there is a tendency that saturation magnetization of the powder is likely to decrease.

In the composition formula, "d" represents a molar ratio of silicon (Si), and from the viewpoint of the withstand voltage property and the strength of the dust core, it is preferable that "d" satisfies a relationship of $0 \leq d \leq 0.400$. That is, the soft magnetic metal may not contain Si.

Furthermore, in addition to the viewpoint of the withstand voltage property and the strength of the dust core, from the viewpoint of the soft magnetic characteristics, it is preferable that "d" satisfies a relationship of $0 \leq d \leq 0.200$. The molar ratio (d) of Si is more preferably 0.001 or greater, and still more preferably 0.005 or greater. In addition, the molar ratio (d) of Si is more preferably 0.040 or less. In a case where "d" is within the above-described range, there is a tendency that the coercive force of the soft magnetic metal is likely to decrease. On the other hand, in a case where "d" is excessively large, the coercive force of the soft magnetic metal tends to increase on the contrary.

In the composition formula, "e" represents a molar ratio of carbon (C), and from the viewpoint of the withstand voltage property and the strength of the dust core, it is preferable that "e" satisfies a relationship of $0 \leq e \leq 0.400$. That is, the soft magnetic metal may not contain C.

Furthermore, in addition to the viewpoint of the withstand voltage property and the strength of the dust core, from the viewpoint of the soft magnetic characteristics, it is preferable that "e" satisfies a relationship of $0 \leq e \leq 0.200$. The molar ratio (e) of C is more preferably 0.001 or greater. In addition, the molar ratio (e) of C is more preferably 0.035 or less, and still more preferably 0.030 or less. In a case where "e" is within the above-described range, there is a tendency that the coercive force of the soft magnetic metal is particularly likely to decrease. In a case where "e" is excessively large, the coercive force of the soft magnetic metal tends to increase on the contrary.

In the composition formula, "f" represents a molar ratio of sulfur (S), and from the viewpoint of the withstand voltage property and the strength of the dust core, it is preferable that "f" satisfies a relationship of $0 \leq f \leq 0.040$. That is, the soft magnetic metal may not contain S.

Furthermore, in addition to the viewpoint of the withstand voltage property and the strength of the dust core, from the viewpoint of the soft magnetic characteristics, it is preferable that "f" satisfies a relationship of $0 \leq f \leq 0.020$. The molar ratio (f) of S is more preferably 0.002 or greater. In addition, the molar ratio (f) of S is more preferably 0.010 or less. In a case where "f" is within the above-described range, there is a tendency that the coercive force of the soft magnetic metal is likely to decrease. In a case where "f" is excessively large, the coercive force of the soft magnetic metal tends to increase.

In addition, "f" satisfies a relationship of $f \geq 0.001$, the circularity of the soft metal particle is likely to be improved. When the circularity of the soft magnetic metal particle is improved, the density of the dust core obtained by compression-molding a powder including the soft magnetic metal particles can be improved.

In the composition formula, "$1-(a+b+c+d+e+f)$" represents a molar ratio of iron (Fe). The molar ratio of Fe is not particularly limited, but in this embodiment, from the viewpoint of the withstand voltage property and the strength of the dust core, the molar ratio ($1-(a+b+c+d+e+f)$) of Fe is preferably 0.410 to 0.910.

Furthermore, in addition to the viewpoint of the withstand voltage property and the strength of the dust core, from the viewpoint of the soft magnetic characteristics, the molar ratio ($1-(a+b+c+d+e+f)$) of Fe is preferably 0.700 to 0.850. When the molar ratio of Fe is set within the above-described range, a crystal phase constituted by crystals having a crystal grain size of greater than 100 nm is less likely to further occur.

In addition, as illustrated in the composition formula, a part of iron may be substituted with X1 and/or X2 in terms of a composition.

X1 represents at least one element selected from the group consisting of cobalt (Co) and nickel (Ni). In the composition formula, "$\alpha$" represents a molar ratio of X1, and in this embodiment, "$\alpha$" is preferably 0 or greater. That is, the soft magnetic metal may not contain X1.

In addition, when the number of atoms of the entire composition is set as 100 at %, from the viewpoint of the withstand voltage property and the strength of the dust core, the number of atoms of X1 is preferably 70.00 at % or less. It is preferable to satisfy a relationship of $0 \leq \alpha\{1-(a+b+c+d+e+f)\} \leq 0.7000$.

Furthermore, in addition to the viewpoint of the withstand voltage property and the strength of the dust core, from the viewpoint of the soft magnetic characteristics, the number of atoms of X1 is preferably 40.00 at % or less. That is, it is preferable to satisfy a relationship of $0 \leq \alpha\{1-(a+b+c+d+e+f)\} \leq 0.4000$.

X2 is at least one element selected from the group consisting of aluminum (Al), manganese (Mn), silver (Ag), zinc (Zn), tin (Sn), arsenic (As), antimony (Sb), copper (Cu), chromium (Cr), bismuth (Bi), nitrogen (N), oxygen (O), and rare earth elements. In the composition formula, "β" represents a molar ratio of X2, and in this embodiment, "β" is preferably 0 or greater. That is, the soft magnetic metal may not contain X2.

In addition, when the number of atoms of the entire composition is set as 100 at %, from the viewpoint of the withstand voltage property and the strength of the dust core, the number of atoms of X2 is preferably 6.00 at % or less. That is, it is preferable to satisfy a relationship of $0 \leq \beta\{1-(a+b+c+d+e+f)\} \leq 0.0600$.

Furthermore, in addition to the viewpoint of the withstand voltage property and the strength of the dust core, from the viewpoint of the soft magnetic characteristics, the number of atoms of X2 is preferably 3.00 at % or less. That is, It is preferable to satisfy a relationship of $0 \leq \beta\{1-(a+b+c+d+e+f)\}0.0300$.

Moreover, from the viewpoint of the withstand voltage property and the strength of the dust core, a range (substitution ratio) in which X1 and/or X2 are substituted with iron is set to 0.94 or less of a total number of atoms of Fe in terms of the number of atoms. That is, $0 \leq \alpha+\beta \leq 0.94$.

Furthermore, in addition to the viewpoint of the withstand voltage property and the strength of the dust core, from the viewpoint of the soft magnetic characteristics, a substitution range of X1 and/or X2 with iron is set to be equal to or less than the half of the total number of atoms of Fe in terms of the number of atoms. That is, a relation of $0 \leq \alpha+\beta \leq 0.50$ is satisfied. In the case of $\alpha+\beta > 0.50$, there is a tendency that it is difficult to obtain the soft magnetic metal in which Fe-based nanocrystals precipitate by a heat treatment.

Note that, the Fe-based amorphous alloy may contain elements other than the above-described elements as inevitable impurities. For example, the elements other than the above-described elements may be contained in a total amount of 0.1% by mass with respect to 100% by mass of Fe-based amorphous alloy.

(1.1.2. Fe-Based Nanocrystalline Alloy)

The Fe-based nanocrystalline alloy includes a Fe-based nanocrystal. The Fe-based nanocrystal is a Fe crystal having a crystal grain size of a nanometer-scale and a crystal structure a body-centered cubic structure (bcc) as a crystal structure. In the soft magnetic metal, a number of the Fe-based nanocrystals precipitate and are dispersed in an amorphous phase. In this embodiment, the Fe-based nanocrystals are more suitably obtained by subjecting a Fe-based amorphous alloy having a nano-heterostructure to a heat treatment to grow initial fine crystals.

Accordingly, an average crystal grain size of the Fe-based nanocrystal tends to be slightly greater than an average crystal grain size of initial fine crystals. In this embodiment, the average crystal grain size of the Fe-based nanocrystal is preferably 5 to 30 nm. In regard with the soft magnetic metal in which Fe-based nanocrystals are dispersed in an amorphous phase, high saturation magnetization is likely to be obtained, and a low coercive force is likely to be obtained.

In this embodiment, a composition of the Fe-based nanocrystalline alloy is preferably the same as the composition of the above-described Fe-based amorphous alloy. Accordingly, the above-described explanation relating to the composition of the Fe-based amorphous alloy is applied to an explanation of the composition of the Fe-based nanocrystalline alloy.

(1.2. Coating Part)

As illustrated in FIG. 1, the coating part 10 is formed to cover the surface of the soft magnetic metal particle 2. In addition, in this embodiment, description of "a surface is coated with a material" represents an aspect in which the material is in contact with the surface and is fixed to cover the contact portion. Moreover, the coating part that coats the soft magnetic metal particle may cover at least a part of a surface of the particle, but preferably covers approximately 90% of the surface, and more preferably the entirety of the surface. Furthermore, the coating part may continuously or intermittently cover the surface of particles.

A coating ratio can be measured as follows with respect to the soft magnetic metal particle on which the coating part is formed. A coated particle is observed with a known scanning electron microscope to obtain a composition image. Acquisition of the composition image is preferably performed at 10 locations or greater in a region of approximately 100 μm×100 μm. The obtained composition image is binarized by using commercially available image analysis software so that the coating part is shown in a black color and a region in which an uncoated soft magnetic metal is exposed is shown in a white color, and then a ratio of an area of the coating part with respect to a total area of the coated particle is set as the coating ratio.

Figure 3:
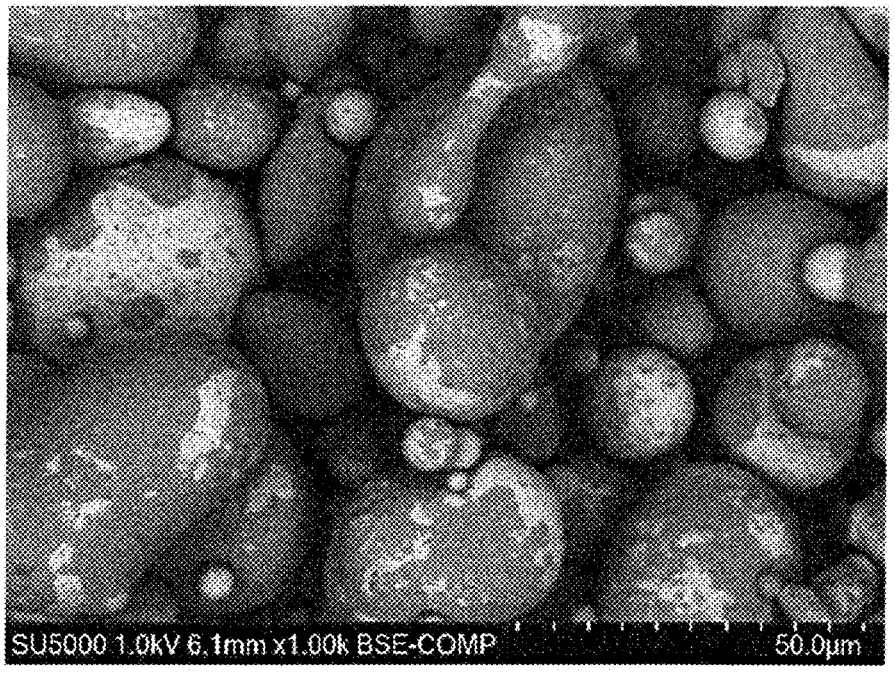
FIG. 3 is a composition image of the coated particles in Examples.

Specifically, FIG. 3 is a composition image of the coated particle. In the composition image, portions difference in a composition (the soft magnetic metal and the coating part) are observed as portions different in contrast, and thus the coated particle on the composition image can be classified into a region corresponding to the coating part and a region corresponding to the soft magnetic metal through binarization. As illustrated in FIG. 3, in the composition image, it can be understood that a number of the soft magnetic metal particles include a relatively black portion (the coating part) and a relatively white portion (the soft magnetic metal). Accordingly, when the image of FIG. 3 is binarized, it is possible to calculate a ratio of an area of the relatively black portion with respect to a total area of the relatively black region (coating part) and the relatively white portion (soft magnetic metal), that is, the coating ratio.

(1.2.1. Composition)

There is no particular limitation as long as the coating part 10 is constituted by a material capable of insulating soft magnetic metal particles constituting the soft magnetic metal powder. That is, the coating part 10 has an insulation property. In this embodiment, it is preferable that the coating part 10 contains at least one element selected from the group consisting of phosphorus (P), aluminum (Al), calcium (Ca), barium (Ba), bismuth (Bi), silicon (Si), chromium (Cr), sodium (Na), zinc (Zn), and oxygen (O). More preferably, the coating part 10 contains a compound containing at least one element selected from the group consisting of phosphorus, zinc, and sodium. More preferably, the compound is an oxide, and still more preferably oxide glass.

In a case where the compound is an oxide, it is preferable that an oxide of at least one element selected from the group consisting of phosphorus, aluminum, calcium, barium, bismuth, silicon, chromium, sodium, and zinc is contained as a main component in the coating part 10. Description of "an oxide of at least one element selected from the group consisting of P, Al, Ca, Ba, Bi, Si, Cr, Na, and Zn is contained as a main component" means that a total amount of at least one kind of element selected from the group consisting of P, Al, Ca, Ba, Bi, Si, Cr, Na, and Zn is the largest when a total amount of elements excluding oxygen among elements contained in the coating part 10 is set as 100% by mass. In addition, in this embodiment, the total amount of these elements is preferably 50% by mass or greater, and more preferably 60% by mass or greater.

The oxide glass is not particularly limited, and examples thereof include phosphate ($P_2O_5$)-based glass, bismuthate ($Bi_2O_3$)-based glass, and borosilicate ($B_2O_3$—$SiO_2$)-based glass.

As the $P_2O_5$-based glass, glass containing 50% by mass or greater of $P_2O_5$ is preferable, and examples thereof include $P_2O_5$—ZnO—$R_2O$—$Al_2O_3$-based glass, and the like. Note that, "R" represents an alkali metal.

As the $Bi_2O_3$-based glass, glass containing 50% by mass or greater of $Bi_2O_3$ is preferable, and examples thereof include $Bi_2O_3$—ZnO—$B_2O_3$—$SiO_2$-based glass, and the like.

As the $B_2O_3$—$SiO_2$-based glass, glass containing 10% by mass or greater of $B_2O_3$ and 10% by mass or greater of $SiO_2$ is preferable, and examples thereof include BaO—ZnO—$B_2O_3$—$SiO_2$—$Al_2O_3$-based glass, and the like.

Since the coating part having an insulation property is included, an insulating property of particles becomes higher. Accordingly, a withstand voltage of the dust core constituted by the soft magnetic metal powder including the coated particles is improved.

Components contained in the coating part can be identified from information such as element analysis by energy dispersive X-ray spectroscopy (EDS) using a transmission electron microscope (TEM) such as a scanning transmission electron microscope (STEM), element analysis by electron energy loss spectroscopy (EELS), a lattice constant obtained by fast Fourier transform (FFT) analysis of a TEM image, and the like.

(1.2.2. Surface Texture)

In this embodiment, a surface texture of the coating part is controlled to a predetermined shape. Specifically, the maximum height Sz of a surface of the coating part is 10 to 700 nm. Sz is one of surface roughness parameters defined in ISO25178, and is the sum of the maximum value of a peak height and a maximum value of a valley depth on a measurement surface (surface of the coating part).

In a case where Sz is within the above-described range, the withstand voltage property and the strength of the dust core can be compatible with each other. When Sz is excessively small, the surface of the coating part is excessively smooth, and thus the strength of the dust core tends to decrease. On the other hand, when Sz is excessively large, a very large uneven portion exists on the surface of the coating part, and thus in the dust core, the unevenness of a coating part of one particle is likely to damage a coating part of another particle, or a lot of extremely thin coating portions and a lot of uncoated portions exist. Accordingly, the withstand voltage property of the dust core tends to deteriorate.

Sz is preferably 20 nm or greater, more preferably 30 nm or greater, and still more preferably 40 nm or greater. On the other hand, Sz is preferably 600 nm or less, more preferably 500 nm or less, and still more preferably 400 nm or less.

Moreover, in this embodiment, an arithmetical mean height Sa of the surface of the coating part is preferably 3 to 50 nm. Sa is one of surface roughness parameters defined in ISO25178, and is a mean value of absolute values of the peak height and the valley depth on the measurement surface (surface of the coating part). Sa is calculated while an influence of local unevenness such as Sz is suppressed and thus Sa is expressed as average surface roughness on the entire measurement surface.

In addition to Sz, in a case where Sa is within the above-described range, both the withstand voltage property and the strength of the dust core become satisfactory, and the withstand voltage property and the strength of the dust core are compatible with each other at a high level. In a case where Sa is out of the above-described range, there is a tendency that only one of the withstand voltage property and the strength of the dust core becomes satisfactory.

Furthermore, in this embodiment, it is preferable that Sz and the thickness of the coating part satisfy a predetermined relationship. Specifically, when the thickness of the coating part is set as T [nm], Sz/T is preferably 1.5 to 30. When controlling Sz in correspondence with the thickness of the coating part, the withstand voltage property and the strength of the dust core are compatible with each other at a higher level.

Sz/T is more preferably 1.8 or greater, and still more preferably 2.0 or greater. On the other hand, Sz/T is more preferably 26 or less, and still more preferably 22 or less.

In this embodiment, even in a viewpoint different from the surface roughness, the surface texture of the coating part is controlled to a predetermined shape. Specifically, the maximum height Rz of a contour curve of the surface of the coating part is 10 to 700 nm. Rz is one of line roughness parameters specified in JIS B601, and is the sum of a maximum value of a peak height and a maximum value of a valley depth on the contour curve having a predetermined length on the measurement surface (surface of the coating part).

In a case where Rz is within the above-described range, as in Sz, the withstand voltage property and the strength of the dust core are compatible with each other. When Rz is excessively small, the surface of the coating part is excessively smooth, and thus the strength of the dust core tends to decrease. On the other hand, when Rz is excessively large, a very large uneven portion exists on the surface of the coating part, and thus in the dust core, the unevenness of a coating part of one particle is likely to damage a coating part of another particle, or a lot of extremely thin coating portions and a lot of uncoated portions exist. Accordingly, the withstand voltage property of the dust core tends to deteriorate.

Rz is preferably 20 nm or greater, more preferably 30 nm or greater, and still more preferably 40 nm or greater. On the other hand, Rz is preferably 600 nm or less, more preferably 500 nm or less, and still more preferably 400 nm or less.

Furthermore, in this embodiment, an arithmetical mean height Ra of the contour curve of the surface of the coating part is preferably 3 to 100 nm. Ra is one of line roughness parameters defined in JIS B601, and is a mean value of absolute values of the peak height and the valley depth of a predetermined length of contour curve of the measurement surface (surface of the coating part). Ra is calculated while an influence of local unevenness such as Rz is suppressed and thus Ra is expressed as average line roughness on the entire contour curve.

In addition to Rz, in a case where Ra is within the above-described range, both the withstand voltage property and the strength of the dust core become satisfactory, and the withstand voltage property and the strength of the dust core are compatible with each other at a high level. In a case where Ra is out of the above-described range, there is a tendency that one of the withstand voltage property and the strength of the dust core becomes satisfactory.

Furthermore, in this embodiment, it is preferable that Rz and the thickness of the coating part satisfy a predetermined relationship. Specifically, when the thickness of the coating part is set as T [nm], Rz/T is preferably 1.5 to 30. When controlling Rz in correspondence with the thickness of the coating part, the withstand voltage property and the strength of the dust core are compatible with each other at a higher level.

Rz/T is more preferably 1.8 or greater, and still more preferably 2.0 or greater. On the other hand, Rz/T is more preferably 26 or less, and still more preferably 22 or less.

The thickness T of the coating part 10 is not particularly limited as long as the above-described relationship is satisfied. In this embodiment, T is preferably 3 to 200 nm. In addition, T is more preferably 5 nm or greater, and still more preferably 10 nm or greater. On the other hand, T is more preferably 70 nm or less, and still more preferably 50 nm or less.

The surface texture of the coating part can be measured as follows. In a case where the surface of the coating part is expressed as an XY plane by using an X-axis and a Y-axis which are orthogonal to each other, the surface texture of the coating part can be expressed as a displacement in a Z-axis direction orthogonal to the XY plane. That is, surface roughness of the coating part is expressed as a three-dimensional (X, Y, Z) shape.

Accordingly, the maximum height Sz and the arithmetical mean height Sa which are surface roughness parameters are calculated from measurement results of the displacement in the Z-axis direction in the measurement region. In this embodiment, in the case of measuring the surface roughness of the coating part formed on the soft magnetic metal particle in the soft magnetic metal powder, it is preferable to use an atomic force microscope (AFM) that is a kind of scanning probe microscope.

The AFM detects an interatomic force acting on between a sample surface and a probe provided at a tip end of a cantilever as a displacement of the cantilever, and measures unevenness of a surface of the sample. Since the AFM has high measurement resolution, the AFM is suitable for measuring nanometer-scale Sz and Sa.

A factor caused by the shape of the surface of the coating part, a factor caused by the surface roughness of the surface of the coating part, and a factor caused by waviness of the surface of the coating part are mainly included in the measurement result of the surface texture of the coating part which is obtained as three-dimensional shape data. Accordingly, the measurement result of the surface texture of the coating part is a contour curved surface obtained by combining the factors. The factors are distinguished by a length of a period (wavelength), the factor caused by the surface roughness has a short period (short wavelength), the factor caused by the shape has a long period (long wavelength), and the factor caused by the waviness has an intermediate period.

Particularly, the soft magnetic metal particle on which the coating part is formed is typically spherical, and thus the obtained measurement result becomes curved depending on a particle diameter of the soft magnetic metal particle in comparison to a measurement result obtained by measuring a flat surface.

Here, an operation of obtaining a surface roughness curved surface constituted by the factor caused by the surface roughness is performed by removing the factor caused by the shape and the factor caused by the waviness from the obtained measurement result. On the basis of the obtained surface roughness curved surface, Sz and Sa are calculated in conformity to a method defined in ISO25178. That is, measurement can be performed in a similar method as in the method defined in ISO25178, but measurement may be performed under conditions different from the conditions described in ISO25178.

The operation of obtaining the surface roughness curved surface from the measurement result can be performed by filter processing, flattening processing, or the like that is known. For example, analysis software attached to the AFM, or commercially available software can be used.

In order to obtain the surface roughness curved surface with high accuracy by appropriately removing the factor caused by the shape and the factor caused by the waviness, it is preferable to measure a surface of a coating part formed on a particle having a regular shape rather than measurement of a surface of a coating part formed on a part having an irregular or distorted shape. Accordingly, in this embodiment, in order to obtain Sz and Sa with high accuracy, it is preferable to perform measurement of the surface texture on a coated particle with high circularity.

With regard to a size of a region in which the surface texture of the coating part is measured, in this embodiment, it is preferable that the region has a rectangular shape in which one side has dimensions of 0.1 to 50 μm×0.1 to 50 μm. It is preferable that the measurement of the surface texture of the coating part is performed at approximately 1 to 10 locations with respect to one coating particle. In addition, it is preferable that the measurement of the surface texture of the coating part is performed on 10 to 1000 coated particles. Average values of Sz and Sa calculated from respective measurement results are set as the maximum height Sz and the arithmetical mean height Sa of the surface of the coating part.

The maximum height Rz and the arithmetical mean height Ra are line roughness. The line roughness is expressed as two-dimensional shape data (contour curve) of a surface in a predetermined reference length section. Accordingly, Rz and Ra can be calculated from the contour curve of the surface of the coating part.

In the three-dimensional shape data of the surface texture of the coating part, a cross-section profile parallel to the Z-axis shows the contour curve of the surface of the coating part. Accordingly, in this embodiment, a line roughness parameter of the coating part formed on the soft magnetic metal particle in the soft magnetic metal powder may be calculated by using the contour curve of the surface of the coating part which is extracted from the three-dimensional shape data of the surface texture of the coating part. Alternatively, the contour curve of the surface of the coating part may be obtained by using a known measurement device.

Moreover, soft magnetic metal particles in the dust core are bound and fixed through a resin. On the other hand, it is necessary to measure the surface roughness parameter in a state in which the measurement surface (surface of the coating part) is exposed. Accordingly, in a case where it is difficult to expose the surface of the coating part, for example, with respect to the coating part formed on the soft magnetic metal particle in the dust core, it is very difficult to measure the surface roughness of the surface of the coating part.

Accordingly, for example, in a cross-section of a coated particle appearing on a cross-section of the dust core, the line roughness parameter may be calculated by obtaining the contour curve of the surface of the coating part. Specifically, the cross-section of the coated particle is observed with a known electron microscope (a scanning electron microscope (SEM), a transmission electron microscope (TEM), or the like), and the coating part is specified, for example, on the basis of a contrast difference and a composition analysis result on an observation image. An outermost surface portion of the specified coating part may be set as the contour curve of the surface of the coating part.

As in the contour curved surface, an operation of obtaining the surface roughness curve constituted by the factor caused by the surface roughness is performed by removing the factor caused by the shape and the factor caused by waviness from the obtained contour curve. Rz and Ra are calculated on the basis of the obtained surface roughness curve in conformity to a method defined in JIS B601. That is, measurement can be performed in a similar method as in the method defined in JIS B601, but measurement may be performed under conditions different from the conditions described in JIS B601.

The operation of obtaining the surface roughness curve from the contour curve can be performed by known filter processing, flattening processing, or the like as in the operation of obtaining the surface roughness curved surface. For example, analysis software attached to the AFM, or commercially available software can be used.

Moreover, as with Sz and Sa, in this embodiment, even in a case where the coated particle is included in the soft magnetic metal powder or is fixed in the dust core, in order to obtain Rz and Ra with high accuracy in any case, it is preferable to perform the measurement of the surface texture on a coated particle with high circularity.

In this embodiment, a reference length of the contour curve is preferably 0.1 to 50 μm. It is preferable that the measurement of the contour curve of the coating part is performed at approximately 10 to 100 locations with respect to one coating particle. In addition, it is preferable that the measurement of the contour curve of the coating part is performed on 10 to 100 coated particles. Average values of Rz and Ra calculated from respective measurement results are set as the maximum height Rz and the arithmetical mean height Ra of the surface of the coating part.

The thickness T of the coating part can be measured as follows. The thickness can be measured by observing a cross-section of the coated particle with a known electron microscope (a scanning electron microscope (SEM), a transmission electron microscope (TEM), or the like), and by specifying the coating part, for example, on the basis of a contrast difference and a composition analysis result on an observation image. In this embodiment, it is preferable that the measurement of the thickness T of the coating part is performed at approximately 1 to 10 locations with respect to one coated particle. In addition, it is preferable that the measurement of the thickness T of the coating part is performed on 10 to 100 coated particles. An average value of thicknesses calculated from respective measurement results is set as the thickness T of the coating part.

(2. Dust Core)

The dust core according to this embodiment is not particularly limited as long as the dust core includes the above-described soft magnetic metal powder, and is formed to have a predetermined shape. In this embodiment, the dust core includes the soft magnetic metal powder and a resin as a binding agent, and soft magnetic metal particles constituting the soft magnetic metal powder are bound to each other through the resin and are fixed in a predetermined shape. In addition, the dust core may be constituted by a mixed powder of the above-described soft magnetic metal powder and another magnetic powder, and may be formed in a predetermined shape.

(3. Magnetic Component)

The magnetic component according to this embodiment is not particularly limited as long as the magnetic component includes the above-described dust core. For example, the magnetic component may be a magnetic component in which an air-core coil formed by winding a wire is embedded inside the dust core having a predetermined shape, or may be a magnetic component in which a wire is wound around a surface of the dust core having a predetermined shape with a predetermined number of turns. The magnetic component according to this embodiment has a satisfactory withstand voltage property, and is suitable for a power inductor used in a power supply circuit.

(4. Method for Manufacturing Dust Core) Next, description will be given of a method for manufacturing the dust core including the magnetic component. First, description will be given of a method for manufacturing the soft magnetic metal powder constituting the dust core.

(4.1. Method for Manufacturing Soft Magnetic Metal Powder)

The soft magnetic metal powder according to this embodiment can be obtained by using a method similar to a known method for manufacturing a soft magnetic metal powder. Specifically, the soft magnetic metal powder can be manufactured by using a gas atomizing method, a water atomizing method, a rotating disk method, or the like. In addition, the soft magnetic metal powder may be manufactured by mechanically crushing a ribbon obtained through a single roll method or the like. Among the methods, it is preferable to use the gas atomization method from the viewpoint that the soft magnetic metal powder having desired magnetic characteristics are easily obtained.

In the gas atomization method, first, a molten metal of a raw material of the soft magnetic metal that constitutes the soft magnetic metal powder is obtained. Raw materials (a pure metal and the like) of respective metal elements contained in the soft magnetic metal are prepared, and the raw materials are weighed to be a composition of a finally obtained soft magnetic metal, and the resultant raw materials are melted. Note that, a method of melting the raw materials of the metal elements is not particularly limited, and examples thereof include a method of melting the raw materials with high frequency heating after evacuating in a chamber of an atomizing device. A temperature at the time of the melting may be determined in consideration of melting points of the metal elements, and may be set to, for example, 1200° C. to 1500° C.

The obtained molten metal is supplied into a chamber as a linear continuous fluid through a nozzle provided in the bottom of a crucible, and a high-pressure gas is sprayed to the supplied molten metal to make the molten metal into liquid droplets, and the liquid droplets are rapidly cooled to obtain fine powder. A gas injection temperature, a pressure inside the chamber, and the like may be determined depending on a composition, and a structure (crystalline, an amorphous alloy, or a nanocrystalline alloy) of the soft magnetic metal, or the like. Note that, with regard to a particle size, particle size adjustment can be performed by sieving classification, airflow classification, or the like.

The obtained powder includes soft magnetic metal particles of a crystalline soft magnetic metal, or soft magnetic metal particles of a soft magnetic metal that is an amorphous alloy. In a case where the soft magnetic metal is constituted by the nanocrystalline alloy, it is preferable that the powder including soft magnetic metal particles constituted by an amorphous alloy is subjected to a heat treatment so as to cause a Fe-based nanocrystal to precipitate. In this case, the powder may be a soft magnetic metal having a nano-heterostructure, or may be constituted by an amorphous alloy in which respective metal elements are uniformly dispersed in amorphous.

Note that, in this embodiment, in a case where a crystal having a crystal grain size of greater than 30 nm exists in the soft magnetic metal before the heat treatment, it is determined that the soft magnetic metal is crystalline, and in a case where the crystal having a crystal grain size of greater than 30 nm does not exist, it is determined that the soft magnetic metal is an amorphous alloy. Note that, whether or not the crystal having a crystal grain size of greater than 30 nm exists in the soft magnetic metal may be evaluated by a known method. Examples thereof include X-ray diffraction measurement, observation with a TEM, and the like. In the case of using the TEM, it can be confirmed by obtaining a selected area diffraction image or a nano beam diffraction image. In the case of using the selected area diffraction image or the nano beam diffraction image, ring-shaped diffraction is obtained in the case of amorphous, whereas a diffraction spot caused by a crystal structure is obtained in the opposite case in a diffraction pattern.

Evaluation of presence or absence of the initial fine crystals, and the average crystal grain size is not particularly limited, and may be made by a known method. For example, confirmation can be made by obtaining a bright-field image or a high-resolution image by using a TEM with respect to a sample thinned through ion milling. Specifically, the presence or absence of the initial fine crystals and the average crystal grain size can be visually evaluated by observing the bright-field image or the high-resolution image obtained at a magnification of $1.00\times10^5$ to $3.00\times10^5$ times.

Next, the obtained powder is subjected to a heat treatment as necessary. By performing the heat treatment, diffusion of elements constituting the soft magnetic metal is promoted and a thermodynamic equilibrium state is reached in a short time while preventing particles from being sintered and being coarsened. Accordingly, a strain or a stress existing in the soft magnetic metal can be removed. As a result, it is easy to obtain a powder constituted by the soft magnetic metal in which the Fe-based nanocrystal precipitates.

In this embodiment, heat treatment conditions are not particularly limited as long as the Fe-based nanocrystal easily precipitates under the conditions. For example, the heat treatment temperature can be set to 400° C. to 700° C., and holding time can be set to 0.5 to 10 hours.

After the heat treatment, a powder including the soft magnetic metal particles constituted by the soft magnetic metal in which the Fe-based nanocrystal precipitate is obtained.

Next, a coating part is formed on the soft magnetic metal particles included in a powder before the heat treatment or a powder after the heat treatment. A method for forming the coating part is not particularly limited, but a known method can be employed. The coating part may be formed by performing a wet treatment on the soft magnetic metal particles, or the coating part may be formed by performing a dry treatment. In addition, the coating part may be formed on the soft magnetic metal powder before performing the heat treatment.

Figure 2:
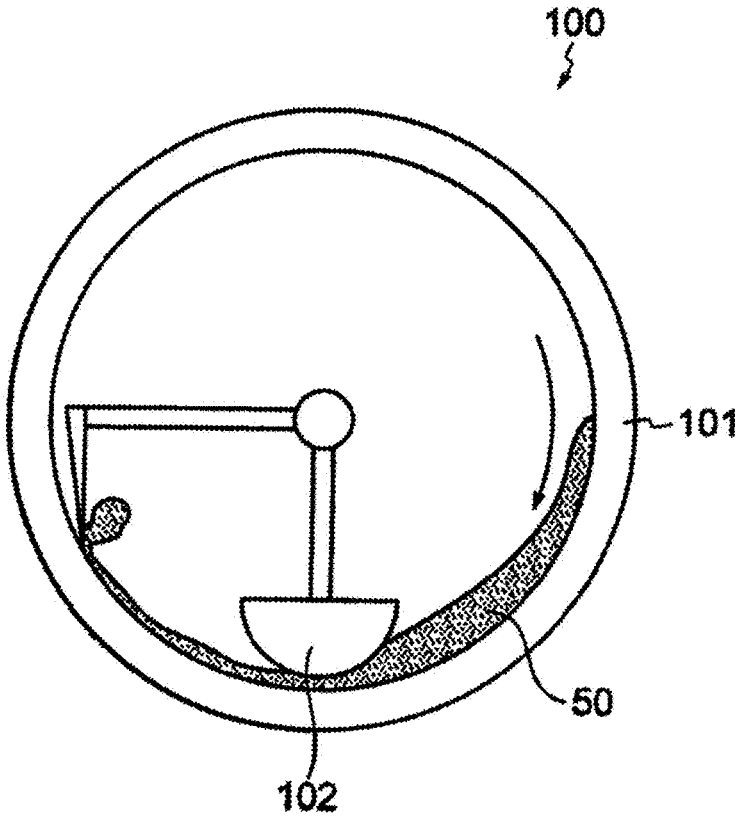
FIG. 2 is a cross-sectional schematic view illustrating a configuration of a powder coating device that is used to form the coating part.

In this embodiment, the coating part can be formed by a coating method using mechanochemical, a phosphate treatment method, a sol-gel method, or the like. In the coating method using mechanochemical, for example, a powder coating device 100 illustrated in FIG. 2 is used. A mixture of the soft magnetic metal powder, and a powder-shaped coating material of a substance (a compound of P, Al, Ca, Ba, Bi, Si, Cr, Na, and Zn, and the like) constituting the coating part is put into a container 101 of the powder coating device. After putting into the mixture the container 101, a grinder 102 is rotated, and thus the mixture 50 of the soft magnetic metal powder and the powder-shaped coating material is compressed between the grinder 102 and an inner wall of the container 101, and friction occurs and heat is generated. Due to the frictional heat generated, the powder-shaped coating material is softened, and is fixed to a surface of the soft magnetic metal particles due to a compressing operation, thereby forming the coating part.

In the coating method using mechanochemical, the frictional heat generated is controlled by adjustment of a rotation speed of the container, a distance between the grinder and the inner wall of the container, and the like and thus a temperature of the mixture of the soft magnetic metal powder and the powder-shaped coating material can be controlled. In this embodiment, the temperature is preferably 50° C. to 150° C. When the temperature is set within the temperature range, the coating part is likely to be formed so as to cover the surface of each of the soft magnetic metal particles. In addition, when adjusting coating time, surface roughness of the coating part, particularly, Sz and Rz tends to be easily controlled. Furthermore, when adjusting a mixing ratio between the soft magnetic metal powder and a powder of the material constituting the coating part, control of the coating thickness T tends to be easy.

Moreover, after forming the coating part, the powder may be subjected to a heat treatment as necessary. Due to the heat treatment, the material constituting the coating part is softened, and thus the surface roughness of the coating part, particularly, Sa and Ra tends to be easily controlled. For example, when a heat treatment temperature is high, or heat treatment time is long, Sa and Ra tend to be small.

(4.2. Method for Manufacturing Dust Core)

The dust core is manufactured by using the above-described soft magnetic metal powder. A specific manufacturing method is not particularly limited, but a known method can be employed. First, the soft magnetic metal powder including the soft magnetic metal particles on which the coating part is formed, and a known resin as a binding agent are mixed, thereby obtaining a mixture. Alternatively, the obtained mixture may be made into a granulated powder as necessary. Then, the mixture or the granulated powder is filled in a mold and is subjected to compression molding, thereby obtaining a green compact having a shape of the dust core to be manufactured. Since the sphericity of the soft magnetic metal particles is high, the soft magnetic metal particles are densely filled in the mold by compressing and molding the powder including the soft magnetic metal particles, and thus a dust core with high density can be obtained.

When the obtained green compact is subjected to a heat treatment, for example, at a temperature of 50° C. to 200° C., the resin is cured, and the dust core having a predetermined shape in which the soft magnetic metal particles are fixed through the resin is obtained. A wire is wound around the obtained dust core with a predetermined number of turns, thereby obtaining a magnetic component such as an inductor.

Alternatively, the mixture or the granulated powder, and an air-core coil in which a wire is wound with a predetermined number of turns may be filled in the mold and may be subjected to compression molding to obtain a green compact in which the coil is embedded. When a heat treatment is performed on the obtained green compact, a dust core having a predetermined shape in which the coil is embedded is obtained. Since the coil is embedded inside, the dust core functions as a magnetic component such as an inductor.

Hereinbefore, the embodiment of the invention has been described, but the invention is not limited to the embodiment any more, and may be modified in various aspects within the scope of the invention.

EXAMPLES

Hereinafter, the invention will be described in more detail with reference to examples, but the invention is not limited to the examples.

Experiment 1

First, raw material metals of the soft magnetic metal were prepared. The prepared raw material metals were weighed to be a predetermined composition, and were put into a crucible disposed inside an atomizing device. Next, the inside of a chamber was evacuated, and the crucible was heated by high frequency induction by using a work coil provided at the outside of the crucible to melt and mix the raw material metals in the crucible, thereby obtaining a molten metal in a temperature of 1250° C. In Examples 1 to 35, and Comparative Examples 1 and 2, the composition of the soft magnetic metal was Fe-7.6Si-2.3B-7.3Nb-1.1Cu. In Example 36, the composition of the soft magnetic metal was Fe-6.5Si-2.6B-2.5Cr. In Example 37, the composition of the soft magnetic metal was Fe-4.5Si. Note that, Fe-4.5Si represents a composition containing 95.5% by mass of Fe, and 4.5% by mass of Si. This is also true of the other compositions.

The obtained molten metal was supplied into the chamber as a linear continuous fluid through a nozzle provided in the bottom of the crucible, and a gas was sprayed to the supplied molten metal, thereby obtaining a powder. A gas injection temperature was set to 1250° C., and a pressure inside the chamber was set to 1 hPa. Note that, an average particle diameter (D50) of the obtained powder was 20 μm. In addition, average circularity of a cross-section of the particles included in the obtained powder was 0.80 to 0.90.

X-ray diffraction measurement was performed on the obtained powder, and presence or absence of a crystal having a crystal grain size greater than 30 nm was confirmed. Then, in a case where a crystal having a crystal grain size greater than 30 nm did not exist, it was determined that the soft magnetic metal constituting the powder was an amorphous alloy, and in a case where the crystal having a crystal grain size greater than 30 nm existed, it was determined that the soft magnetic metal was crystalline. The results are shown in Table 1. In Example 36, an average crystal grain size of initial fine crystals was 2 nm.

Next, the powders of Examples 1 to 35, and Comparative Examples 1 and 2 were subjected to a heat treatment. As heat treatment conditions, a heat treatment temperature was set to 600° C., and holding time was set to one hour. X-ray diffraction measurement and observation with a TEM were performed on the powder after the heat treatment to evaluate whether or not the Fe-based nanocrystal existed. The results are shown in Table 1. Note that, in Examples in which the Fe-based nanocrystal existed, it was confirmed that a crystal structure of the Fe-based nanocrystal was a bcc structure, and an average crystal grain size was 5 to 30 nm.

Next, powders of Examples 1 to 37, and Comparative Examples 1 and 2 together with a powder-shaped coating material of a material shown in Table 1 were put into a container of a powder coating device to coat a surface of the particles with the powder-shaped coating material and to form the coating part, thereby obtaining the soft magnetic metal powder. The amount of the powder-shaped coating material added was set to 0.01% by mass to 3% by mass with respect to 100% by mass of powder after the heat treatment. In addition, coating time was set to 0.1 to 8 hours, and a temperature of a mixture of the powder after the heat treatment and the powder-shaped coating material was 50° C. to 150° C. A number ratio of the coated particles in the powder after forming the coating part was 85% to 95%.

In Examples 1 to 25, 36, 37, and Comparative Examples 1 and 2, as the powder-shaped coating material, phosphate-based glass having a composition of $P_2O_5$—ZnO—$R_2O$—$Al_2O_3$ was used. As a specific composition, $P_2O_5$ was 50% by mass, ZnO was 12% by mass, $R_2O$ was 20% by mass, $Al_2O_3$ was 6% by mass, and the remainder was a sub-component.

Note that, the present inventors have also conducted similar experiments using a glass having a composition in which $P_2O_5$ was 60% by mass, ZnO was 20% by mass, $R_2O$ was 10% by mass, $Al_2O_3$ was 5% by mass, and the remainder was a sub-component, and the like, and it has been confirmed that results similar to results to be described later were obtained.

A surface texture was measured as follows with respect to the soft magnetic metal particles on which the coating part was formed. As a measurement device, a scanning probe microscope (AFM5100N, manufactured by Hitachi High-Tech Science Corporation) was used. As a cantilever, SI-DF40 (a spring constant: 42 N/m and a resonance frequency: 250 to 390 kHz) manufactured by Hitachi High-Tech Science Corporation was used, and a radius of curvature of a tip end of the probe was 10 nm.

A measurement mode of an atomic force microscope was set to a dynamic force mode, one square region of 5 μm×5 μm was selected on a surface of the coating part of the soft magnetic metal particles having circularity of 0.98 or greater, and measurement was performed on the region. 30 particles were measured. After surface texture data obtained was subjected to tertiary inclination correction by using software attached to the atomic force microscope on the basis of ISO25178, Sz and Sa in respective regions were calculated. The results are shown in Table 1.

With respect to the soft magnetic metal particles on which the coating part was formed, the thickness T of the coating part was measured as follows. A cross-section of a particle was observed with a TEM, and the coating part was specified by a contrast difference on an observation image. In the specified coating part, the thickness was measured at 10 locations. Measurement of the thickness was performed on 10 particles, and an average value of the measured thicknesses was set as the thickness T of the coating part. The results are shown in Table 1.

Next, the dust core was manufactured. An epoxy resin that was a thermosetting resin and an imide resin that was a curing agent were weighed so that a total amount thereof becomes 3% by mass with respect to 100% by mass of soft magnetic metal powder obtained, and the resins were added to acetone to form a solution, and the solution and the soft magnetic metal powder were mixed with each other. After the mixing, granules obtained by volatilizing the acetone were sieved with a mesh of 355 μm. The granules were filled in a toroidal mold having an outer diameter of 11 mm and an inner diameter of 6.5 mm, and were compressed at a molding pressure of 3.0 t/cm$^2$, thereby obtaining a green compact of the dust core. The obtained green compact of the dust core was cured at 180° C. for one hour, thereby obtaining the dust core.

The strength of the dust core that was obtained was measured as follows. As a measurement device, a strength tester (MODEL-1311D, manufactured by Aikoh Engineering Co., Ltd.) was used. A load was applied to the dust core in a diameter direction by using the strength tester, and radial crushing strength of the dust core was calculated from the load P [kgf] when the dust core was broken by using the following expression. When an outer diameter of the dust core is set as D, a thickness calculated from a difference between the outer diameter and an inner diameter is set as A, and a length of the dust core is set as L, the radial crushing strength K [MPa] is calculated from $K=P(D-A)/LA^2$. In the present examples, it was determined that a sample having the radial crushing strength of 15 MPa or greater was satisfactory. The results are shown in Table 1.

Moreover, In—Ga electrodes were formed on both ends of the obtained dust core sample, a voltage was applied to the both ends by using a voltage-rising destruction tester (THK-2011ADMPT manufactured by TAMADENSOKU CO, LTD.), and a withstand voltage was calculated from a voltage value when a current of 1 mA flows and a length L of the dust core. In the present examples, it was determined that a sample of which the withstand voltage was 80 V/mm or greater was satisfactory. The results are shown in Table 1.

From Table 1, in a case where Sz was within the above-described range, it could be confirmed that both the strength and the withstand voltage property of the dust core were satisfactory.

In contrast, in a case where Sz was out of the above-described range, it could be confirmed that one of the strength and the withstand voltage property of the dust core was poor.

Experiment 2

A soft magnetic metal powder was manufactured by the same method as in Experiment 1 except that Rz and Ra in respective regions were calculated after performing the tertiary inclination correction on the obtained surface texture data on the basis of JIS B601 by using the software attached to the atomic force microscope, and the same evaluation as in Experiment 1 was performed. In addition, a dust core was manufactured by the same method as in Experiment 1 by using the obtained powder, and the same evaluation as in Experiment 1 was performed. The results are shown in Table 2.

Note that, Examples in 38 to 54 and 209 to 226, and Comparative Examples 3 and 4, the composition of the soft

TABLE 1

| | Coating part | | | | | Soft magnetic metal Structure | Dust core | |
|---|---|---|---|---|---|---|---|---|
| | Sz (nm) | Sa (nm) | Sz/T | Thickness T (nm) | Material | | Strength (MPa) | Withstand voltage (V/mm) |
| Example 1 | 10 | 1.3 | 0.4 | 24 | $P_2O_5$—ZnO—$R_2O$—$Al_2O_3$ | Nanocrystal | 23 | 287 |
| Example 2 | 21 | 2.1 | 0.8 | 25 | $P_2O_5$—ZnO—$R_2O$—$Al_2O_3$ | Nanocrystal | 31 | 286 |
| Example 3 | 32 | 2.9 | 1.4 | 23 | $P_2O_5$—ZnO—$R_2O$—$Al_2O_3$ | Nanocrystal | 37 | 282 |
| Example 4 | 44 | 4.3 | 1.7 | 26 | $P_2O_5$—ZnO—$R_2O$—$Al_2O_3$ | Nanocrystal | 43 | 276 |
| Example 5 | 121 | 8.2 | 5.0 | 24 | $P_2O_5$—ZnO—$R_2O$—$Al_2O_3$ | Nanocrystal | 51 | 272 |
| Example 6 | 396 | 34 | 17 | 23 | $P_2O_5$—ZnO—$R_2O$—$Al_2O_3$ | Nanocrystal | 55 | 233 |
| Example 7 | 497 | 37 | 19 | 26 | $P_2O_5$—ZnO—$R_2O$—$Al_2O_3$ | Nanocrystal | 57 | 197 |
| Example 8 | 595 | 54 | 25 | 24 | $P_2O_5$—ZnO—$R_2O$—$Al_2O_3$ | Nanocrystal | 59 | 167 |
| Example 9 | 698 | 62 | 33 | 21 | $P_2O_5$—ZnO—$R_2O$—$Al_2O_3$ | Nanocrystal | 61 | 117 |
| Example 10 | 25 | 3.1 | 1.1 | 22 | $P_2O_5$—ZnO—$R_2O$—$Al_2O_3$ | Nanocrystal | 35 | 283 |
| Example 11 | 563 | 49.8 | 27 | 21 | $P_2O_5$—ZnO—$R_2O$—$Al_2O_3$ | Nanocrystal | 59 | 166 |
| Example 12 | 33 | 3.2 | 1.5 | 22 | $P_2O_5$—ZnO—$R_2O$—$Al_2O_3$ | Nanocrystal | 39 | 281 |
| Example 13 | 41 | 3.7 | 1.8 | 23 | $P_2O_5$—ZnO—$R_2O$—$Al_2O_3$ | Nanocrystal | 42 | 278 |
| Example 14 | 48 | 4.1 | 2.0 | 24 | $P_2O_5$—ZnO—$R_2O$—$Al_2O_3$ | Nanocrystal | 46 | 275 |
| Example 15 | 550 | 45 | 22 | 25 | $P_2O_5$—ZnO—$R_2O$—$Al_2O_3$ | Nanocrystal | 55 | 176 |
| Example 16 | 598 | 47 | 26 | 23 | $P_2O_5$—ZnO—$R_2O$—$Al_2O_3$ | Nanocrystal | 56 | 169 |
| Example 17 | 638 | 48 | 29 | 22 | $P_2O_5$—ZnO—$R_2O$—$Al_2O_3$ | Nanocrystal | 57 | 153 |
| Example 18 | 123 | 9.5 | 123 | 1 | $P_2O_5$—ZnO—$R_2O$—$Al_2O_3$ | Nanocrystal | 62 | 189 |
| Example 19 | 125 | 8.9 | 42 | 3 | $P_2O_5$—ZnO—$R_2O$—$Al_2O_3$ | Nanocrystal | 60 | 218 |
| Example 20 | 119 | 10.2 | 24 | 5 | $P_2O_5$—ZnO—$R_2O$—$Al_2O_3$ | Nanocrystal | 57 | 241 |
| Example 21 | 123 | 10.8 | 11 | 11 | $P_2O_5$—ZnO—$R_2O$—$Al_2O_3$ | Nanocrystal | 54 | 263 |
| Example 22 | 126 | 11.6 | 2.3 | 54 | $P_2O_5$—ZnO—$R_2O$—$Al_2O_3$ | Nanocrystal | 46 | 279 |
| Example 23 | 118 | 9.2 | 1.6 | 72 | $P_2O_5$—ZnO—$R_2O$—$Al_2O_3$ | Nanocrystal | 41 | 286 |
| Example 24 | 117 | 9.7 | 0.6 | 197 | $P_2O_5$—ZnO—$R_2O$—$Al_2O_3$ | Nanocrystal | 36 | 289 |
| Example 25 | 112 | 6.8 | 0.4 | 308 | $P_2O_5$—ZnO—$R_2O$—$Al_2O_3$ | Nanocrystal | 31 | 291 |
| Example 26 | 92 | 8.4 | 3.8 | 24 | $P_2O_5$ | Nanocrystal | 53 | 234 |
| Example 27 | 62 | 5.2 | 3.4 | 18 | $Al_2O_3$ | Nanocrystal | 53 | 187 |
| Example 28 | 81 | 6.7 | 3.1 | 26 | CaO | Nanocrystal | 45 | 227 |
| Example 29 | 86 | 7.2 | 4.1 | 21 | BaO | Nanocrystal | 61 | 164 |
| Example 30 | 79 | 4.8 | 3.3 | 24 | $Bi_2O_3$ | Nanocrystal | 45 | 228 |
| Example 31 | 87 | 9.1 | 3.8 | 23 | $SiO_2$ | Nanocrystal | 42 | 215 |
| Example 32 | 101 | 7.5 | 4.0 | 25 | $Cr_2O_3$ | Nanocrystal | 51 | 211 |
| Example 33 | 98 | 10.3 | 4.1 | 24 | $Na_2O$ | Nanocrystal | 48 | 192 |
| Example 34 | 117 | 9.5 | 4.3 | 27 | ZnO | Nanocrystal | 56 | 173 |
| Example 35 | 91 | 6.9 | 4.1 | 22 | CuO | Nanocrystal | 69 | 109 |
| Example 36 | 117 | 12.3 | 4.5 | 26 | $P_2O_5$—ZnO—$R_2O$—$Al_2O_3$ | Amorphous | 48 | 268 |
| Example 37 | 106 | 9.5 | 4.2 | 25 | $P_2O_5$—ZnO—$R_2O$—$Al_2O_3$ | Crystalline | 46 | 214 |
| Comparative Example 1 | 5 | 1.1 | 0.2 | 25 | $P_2O_5$—ZnO—$R_2O$—$Al_2O_3$ | Nanocrystal | 9 | 291 |
| Comparative Example 2 | 915 | 83 | 35 | 26 | $P_2O_5$—ZnO—$R_2O$—$Al_2O_3$ | Nanocrystal | 63 | 53 |

magnetic metal was Fe-7.6Si-2.3B-7.3Nb-1.1Cu. In Example 227, the composition of the soft magnetic metal was Fe-6.5Si-2.6B-2.5Cr. In Example 228, the composition of the soft magnetic metal was Fe-4.5Si.

In Examples 38 to 54, 209 to 216, 227, and 228, and Comparative Examples 3 and 4, as the powder-shaped coating material, phosphate-based glass having a composition of $P_2O_5$—ZnO—$R_2O$—$Al_2O_3$ was used. As a specific composition, $P_2O_5$ was 50% by mass, ZnO was 12% by mass, $R_2O$ was 20% by mass, $Al_2O_3$ was 6% by mass, and the remainder was a sub-component.

Note that, the present inventors have also conducted similar experiments using a glass having a composition in which $P_2O_5$ was 60% by mass, ZnO was 20% by mass, $R_2O$ was 10% by mass, $Al_2O_3$ was 5% by mass, and the remainder was a sub-component, and the like, and it has been confirmed that results similar to results to be described later were obtained with respect to Rz and Ra.

TABLE 2

| | Coating part | | | | | Soft magnetic | Dust core | |
|---|---|---|---|---|---|---|---|---|
| | Rz (nm) | Ra (nm) | Rz/T | Thickness T (nm) | Material | metal Structure | Strength (MPa) | Withstand voltage (V/mm) |
| Example 38 | 11 | 1.2 | 0.5 | 23 | $P_2O_5$—ZnO—$R_2O$—$Al_2O_3$ | Nanocrystal | 25 | 291 |
| Example 39 | 22 | 2.3 | 1.0 | 23 | $P_2O_5$—ZnO—$R_2O$—$Al_2O_3$ | Nanocrystal | 32 | 287 |
| Example 40 | 34 | 2.8 | 1.4 | 25 | $P_2O_5$—ZnO—$R_2O$—$Al_2O_3$ | Nanocrystal | 38 | 284 |
| Example 41 | 41 | 3.6 | 1.7 | 24 | $P_2O_5$—ZnO—$R_2O$—$Al_2O_3$ | Nanocrystal | 45 | 279 |
| Example 42 | 125 | 11.5 | 5.0 | 25 | $P_2O_5$—ZnO—$R_2O$—$Al_2O_3$ | Nanocrystal | 51 | 267 |
| Example 43 | 397 | 38 | 15 | 26 | $P_2O_5$—ZnO—$R_2O$—$Al_2O_3$ | Nanocrystal | 54 | 251 |
| Example 44 | 491 | 52 | 18 | 27 | $P_2O_5$—ZnO—$R_2O$—$Al_2O_3$ | Nanocrystal | 57 | 226 |
| Example 45 | 592 | 65 | 24 | 25 | $P_2O_5$—ZnO—$R_2O$—$Al_2O_3$ | Nanocrystal | 60 | 187 |
| Example 46 | 697 | 124 | 28 | 25 | $P_2O_5$—ZnO—$R_2O$—$Al_2O_3$ | Nanocrystal | 64 | 132 |
| Example 47 | 25 | 3.2 | 1.0 | 24 | $P_2O_5$—ZnO—$R_2O$—$Al_2O_3$ | Nanocrystal | 36 | 287 |
| Example 48 | 680 | 97 | 31 | 22 | $P_2O_5$—ZnO—$R_2O$—$Al_2O_3$ | Nanocrystal | 62 | 144 |
| Example 49 | 33 | 4.1 | 1.52 | 22 | $P_2O_5$—ZnO—$R_2O$—$Al_2O_3$ | Nanocrystal | 44 | 286 |
| Example 50 | 41 | 4.5 | 1.8 | 23 | $P_2O_5$—ZnO—$R_2O$—$Al_2O_3$ | Nanocrystal | 48 | 281 |
| Example 51 | 50 | 6.2 | 2.0 | 25 | $P_2O_5$—ZnO—$R_2O$—$Al_2O_3$ | Nanocrystal | 51 | 275 |
| Example 52 | 528 | 54 | 22 | 24 | $P_2O_5$—ZnO—$R_2O$—$Al_2O_3$ | Nanocrystal | 56 | 208 |
| Example 53 | 572 | 62 | 26 | 22 | $P_2O_5$—ZnO—$R_2O$—$Al_2O_3$ | Nanocrystal | 58 | 197 |
| Example 54 | 588 | 78 | 28 | 21 | $P_2O_5$—ZnO—$R_2O$—$Al_2O_3$ | Nanocrystal | 60 | 191 |
| Example 209 | 107 | 9.4 | 54 | 2 | $P_2O_5$—ZnO—$R_2O$—$Al_2O_3$ | Nanocrystal | 61 | 184 |
| Example 210 | 115 | 10.3 | 38 | 3 | $P_2O_5$—ZnO—$R_2O$—$Al_2O_3$ | Nanocrystal | 59 | 215 |
| Example 211 | 104 | 8.9 | 17 | 6 | $P_2O_5$—ZnO—$R_2O$—$Al_2O_3$ | Nanocrystal | 56 | 238 |
| Example 212 | 121 | 10.4 | 10 | 12 | $P_2O_5$—ZnO—$R_2O$—$Al_2O_3$ | Nanocrystal | 53 | 259 |
| Example 213 | 112 | 9.6 | 2.0 | 57 | $P_2O_5$—ZnO—$R_2O$—$Al_2O_3$ | Nanocrystal | 47 | 274 |
| Example 214 | 117 | 10.5 | 1.6 | 74 | $P_2O_5$—ZnO—$R_2O$—$Al_2O_3$ | Nanocrystal | 43 | 281 |
| Example 215 | 114 | 11.2 | 0.6 | 198 | $P_2O_5$—ZnO—$R_2O$—$Al_2O_3$ | Nanocrystal | 38 | 285 |
| Example 216 | 109 | 9.7 | 0.3 | 317 | $P_2O_5$—ZnO—$R_2O$—$Al_2O_3$ | Nanocrystal | 33 | 288 |
| Example 217 | 81 | 7.2 | 3.7 | 22 | $P_2O_5$ | Nanocrystal | 54 | 221 |
| Example 218 | 60 | 6.7 | 2.5 | 24 | $Al_2O_3$ | Nanocrystal | 52 | 196 |
| Example 219 | 79 | 8.1 | 3.8 | 21 | CaO | Nanocrystal | 46 | 219 |
| Example 220 | 78 | 8.2 | 4.1 | 19 | BaO | Nanocrystal | 62 | 172 |
| Example 221 | 76 | 7.5 | 2.8 | 27 | $Bi_2O_3$ | Nanocrystal | 43 | 224 |
| Example 222 | 84 | 8.6 | 3.7 | 23 | $SiO_2$ | Nanocrystal | 48 | 206 |
| Example 223 | 93 | 8.9 | 4.4 | 21 | $Cr_2O_3$ | Nanocrystal | 49 | 212 |
| Example 224 | 95 | 9.7 | 5.3 | 18 | $Na_2O$ | Nanocrystal | 47 | 203 |
| Example 225 | 108 | 10.6 | 3.9 | 28 | ZnO | Nanocrystal | 52 | 182 |
| Example 226 | 89 | 8.8 | 3.6 | 25 | CuO | Nanocrystal | 67 | 117 |
| Example 227 | 113 | 10.3 | 4.7 | 24 | $P_2O_5$—ZnO—$R_2O$—$Al_2O_3$ | Amorphous | 49 | 271 |
| Example 228 | 98 | 11.5 | 4.3 | 23 | $P_2O_5$—ZnO—$R_2O$—$Al_2O_3$ | Crystalline | 48 | 228 |
| Comparative Example 3 | 5 | 0.8 | 0.2 | 23 | $P_2O_5$—ZnO—$R_2O$—$Al_2O_3$ | Nanocrystal | 10 | 295 |
| Comparative Example 4 | 942 | 132 | 39 | 24 | $P_2O_5$—ZnO—$R_2O$—$Al_2O_3$ | Nanocrystal | 67 | 64 |

From Table 2, in a case where Rz was within the above-described range, it could be confirmed that both the strength and the withstand voltage property of the dust core were satisfactory.

In contrast, in a case where Rz was out of the above-described range, it could be confirmed that one of the strength and the withstand voltage property of the dust core was poor.

Experiment 3

A soft magnetic metal powder was manufactured by the same method as in Example 1 except that a number ratio of the coated particles was set to values shown in Table 3, and the same evaluation as in Experiment 1 was performed. In addition, a dust core was manufactured by the same method as in Experiment 1 by using the obtained powder, and the same evaluation as in Experiment 1 was performed. The results are shown in Table 3.

Moreover, a soft magnetic metal powder was manufacture by the same method as in Example 1 of Experiment 1 except that average circularity of the soft magnetic metal particles was set to values shown in Table 4, and the same evaluation as in Experiment 1 was performed. In addition, a dust core was manufactured by the same method as in Experiment 1 by using the obtained powder, and the same evaluation as in Experiment 1 was performed. The results are shown in Table 4.

Furthermore, a soft magnetic metal powder was manufactured by the same method as in Example 1 of Experiment 1 except that an average particle diameter of the soft magnetic metal powder was set to values shown in Table 5, and the same evaluation as in Experiment 1 was performed. In addition, a dust core was manufactured by the same method as in Experiment 1 by using the obtained powder, and the same evaluation as in Experiment 1 was performed. The results are shown in Table 5. Note that, in Examples 55 to 65, the composition of the soft magnetic metal and the material of the powder-shaped coating material were the same as in Example 1.

TABLE 3

| | Coating part | | | | | Soft magnetic metal | Coated particle | Dust core | |
|---|---|---|---|---|---|---|---|---|---|
| | Sz (nm) | Sa (nm) | Sz/T | Thickness T (nm) | Material | Structure | Number ratio of coated particle (%) | Strength (MPa) | Withstand voltage (V/mm) |
| Example 55 | 84 | 8.1 | 3.7 | 23 | $P_2O_5$—ZnO—$R_2O$—$Al_2O_3$ | Nanocrystal | 95 | 51 | 276 |
| Example 56 | 79 | 7.4 | 3.3 | 24 | $P_2O_5$—ZnO—$R_2O$—$Al_2O_3$ | Nanocrystal | 90 | 47 | 253 |
| Example 57 | 82 | 7.9 | 3.9 | 21 | $P_2O_5$—ZnO—$R_2O$—$Al_2O_3$ | Nanocrystal | 85 | 46 | 241 |

TABLE 4

| | Coating part | | | | | Soft magnetic metal | | Dust core | |
|---|---|---|---|---|---|---|---|---|---|
| | Sz (nm) | Sa (nm) | Sz/T | Thickness T (nm) | Material | Structure | Circularity | Strength (MPa) | Withstand voltage (V/mm) |
| Example 58 | 81 | 7.9 | 3.5 | 23 | $P_2O_5$—ZnO—$R_2O$—$Al_2O_3$ | Nanocrystal | 0.90 | 51 | 277 |
| Example 59 | 88 | 8.4 | 3.5 | 25 | $P_2O_5$—ZnO—$R_2O$—$Al_2O_3$ | Nanocrystal | 0.85 | 48 | 258 |
| Example 60 | 78 | 8.0 | 2.9 | 27 | $P_2O_5$—ZnO—$R_2O$—$Al_2O_3$ | Nanocrystal | 0.80 | 47 | 239 |

TABLE 5

| | Coating part | | | | | Soft magnetic metal | | Dust core | |
|---|---|---|---|---|---|---|---|---|---|
| | Sz (nm) | Sa (nm) | Sz/T | Thickness T (nm) | Material | Structure | Average particle size (μm) | Strength (MPa) | Withstand voltage (V/mm) |
| Example 61 | 112 | 9.3 | 5.3 | 21 | $P_2O_5$—ZnO—$R_2O$—$Al_2O_3$ | Nanocrystal | 0.1 | 24 | 343 |
| Example 62 | 93 | 8.2 | 4.0 | 23 | $P_2O_5$—ZnO—$R_2O$—$Al_2O_3$ | Nanocrystal | 0.3 | 35 | 331 |
| Example 63 | 88 | 7.6 | 3.7 | 24 | $P_2O_5$—ZnO—$R_2O$—$A1_2O_3$ | Nanocrystal | 24 | 51 | 272 |
| Example 64 | 73 | 8.3 | 3.3 | 22 | $P_2O_5$—ZnO—$R_2O$—$Al_2O_3$ | Nanocrystal | 98 | 34 | 214 |
| Example 65 | 75 | 8.8 | 2.9 | 26 | $P_2O_5$—ZnO—$R_2O$—$A1_2O_3$ | Nanocrystal | 154 | 25 | 184 |

From Table 3 to 5, in addition to a case where the surface roughness was within the above-described range, and in a case where the number ratio of the coated particles, the average circularity of the soft magnetic metal particles, and the average particle size of the soft magnetic metal powder were within the above-described ranges, it could be confirmed that both the strength and the withstand voltage property of the dust core were satisfactory.

Experiment 4

A soft magnetic metal powder was manufactured by the same method as in Example 36 of Experiment 1 except that an average crystal grain size of the initial fine crystals was set to values shown in Table 6, and the same evaluation as in Experiment 1 was performed. In addition, a dust core was manufactured by the same method as in Experiment 1 by using the obtained powder, and the same evaluation as in Experiment 1 was performed. The results are shown in Table 6. Note that, in Examples 66 to 70, the composition of the soft magnetic metal and the material of the powder-shaped coating material were the same as in Example 36.

Moreover, a soft magnetic metal powder was manufacture by the same method as in Example 1 of Experiment 1 except that the average crystal grain size of the nanocrystal was set to values shown in Table 7, and the same evaluation as in Experiment 1 was performed. In addition, a dust core was manufactured by the same method as in Experiment 1 by using the obtained powder, and the same evaluation as in Experiment 1 was performed. The results are shown in Table 7. Note that, in Examples 71 to 75, the composition of the soft magnetic metal and the material of the powder-shaped coating material were the same as in Example 1.

TABLE 6

| | Coating part | | | | | Soft magnetic metal | | Dust core | |
|---|---|---|---|---|---|---|---|---|---|
| | Sz (nm) | Sa (nm) | Sz/T | Thickness T (nm) | Material | Structure | Average crystal grain size of initial fine crystals (nm) | Strength (MPa) | Withstand voltage (V/mm) |
| Example 66 | 86 | 7.7 | 3.6 | 24 | $P_2O_5$—ZnO—$R_2O$—$Al_2O_3$ | Amorphous | 0.1 | 47 | 228 |
| Example 67 | 97 | 9.5 | 4.2 | 23 | $P_2O_5$—ZnO—$R_2O$—$Al_2O_3$ | Amorphous | 0.3 | 50 | 265 |
| Example 68 | 92 | 7.9 | 3.5 | 26 | $P_2O_5$—ZnO—$R_2O$—$Al_2O_3$ | Amorphous | 2 | 51 | 272 |
| Example 69 | 79 | 9.3 | 3.2 | 25 | $P_2O_5$—ZnO—$R_2O$—$Al_2O_3$ | Amorphous | 10 | 48 | 254 |
| Example 70 | 82 | 8.1 | 3.3 | 25 | $P_2O_5$—ZnO—$R_2O$—$Al_2O_3$ | Amorphous | 15 | 52 | 231 |

TABLE 7

| | Coating part | | | | | Soft magnetic metal | | Dust core | |
|---|---|---|---|---|---|---|---|---|---|
| | Sz (nm) | Sa (nm) | Sz/T | Thickness T (nm) | Material | Structure | Average crystal grain size of nanocrystals (nm) | Strength (MPa) | Withstand voltage (V/mm) |
| Example 71 | 96 | 9.2 | 3.8 | 25 | $P_2O_5$—ZnO—$R_2O$—$al_2O_3$ | Nanocrystal | 2 | 52 | 236 |
| Example 72 | 73 | 8.3 | 2.7 | 27 | $P_2O_5$—ZnO—$R_2O$—$Al_2O_3$ | Nanocrystal | 5 | 47 | 247 |
| Example 73 | 93 | 7.5 | 3.9 | 24 | $P_2O_5$—ZnO—$R_2O$—$Al_2O_3$ | Nanocrystal | 21 | 51 | 272 |
| Example 74 | 85 | 9.4 | 3.7 | 23 | $P_2O_5$—ZnO—$R_2O$—$Al_2O_3$ | Nanocrystal | 29 | 49 | 265 |
| Example 75 | 92 | 7.6 | 3.4 | 27 | $P_2O_5$—ZnO—$R_2O$—$Al_2O_3$ | Nanocrystal | 52 | 47 | 235 |

From Table 6 and Table 7, in addition to a case where the surface roughness was within the above-described range, in a case where the average crystal grain size of the initial fine crystals and the average crystal grain size of the nanocrystal were within the above described ranges, it could be confirmed that both the strength and the withstand voltage property of the dust core were compatible with each other at a high level.

Experiment 5

A soft magnetic metal powder was manufactured by the same method as in Example 1 of Experiment 1 except that the amount of $P_2O_5$ in $P_2O_5$—ZnO—$R_2O$—$Al_2O_3$ glass was set to values shown in Table 8, and the same evaluation as in Experiment 1 was performed. In addition, a dust core was manufactured by the same method as in Experiment 1 by using the obtained powder, and the same evaluation as in Experiment 1 was performed. The results are shown in Table 8. Note that, in Examples 76 to 78, the composition of the soft magnetic metal was the same as in Example 1.

Moreover, a soft magnetic metal powder was manufactured by the same method as in Example 1 of Experiment 1 except that the $P_2O_5$—ZnO—$R_2O$—$Al_2O_3$ glass was changed to $Bi_2O_3$—ZnO—$B_2O_3$—$SiO_2$ glass or BaO—ZnO—$B_2O_3$—$SiO_2$—$Al_2O_3$ glass, and the same evaluation as in Experiment 1 was performed. In addition, a dust core was manufactured by the same method as in Experiment 1 by using the obtained powder, and the same evaluation as in Experiment 1 was performed. The results are shown in Tables 9 and 10. Note that, in Examples 79 to 84, the composition of the soft magnetic metal was the same as in Example 1. In a composition of the $Bi_2O_3$—ZnO—$B_2O_3$—$SiO_2$ glass, $Bi_2O_3$ was 40% by mass to 60% by mass, ZnO was 10% by mass to 15% by mass, $B_2O_3$ was 15% by mass to 25% by mass, $SiO_2$ was 15% by mass to 20% by mass, and the remainder was a sub-component. In a composition of the BaO—ZnO—$B_2O_3$—$SiO_2$—$Al_2O_3$ glass, BaO was 35% by mass to 40% by mass, ZnO was 30% by mass to 40% by mass, $B_2O_3$ was 5% by mass to 15% by mass, $SiO_2$ was 5% by mass to 15% by mass, $Al_2O_3$ was 5% by mass to 10% by mass, and the remainder was a sub-component.

TABLE 8

| | Coating part | | | | | Amount of Soft | | Dust core | |
|---|---|---|---|---|---|---|---|---|---|
| | Sz (nm) | Sa (nm) | Sz/T | Thickness T (nm) | Material | $P_2O_5$ contained (wt %) | magnetic metal Structure | Strength (MPa) | Withstand voltage (V/mm) |
| Example 76 | 92 | 9.5 | 4.2 | 22 | $P_2O_5$—ZnO—$R_2O$—$Al_2O_3$ | 60 | Nanocrystal | 51 | 272 |
| Example 77 | 84 | 8.6 | 3.5 | 24 | $P_2O_5$—ZnO—$R_2O$—$Al_2O_3$ | 50 | Nanocrystal | 54 | 246 |
| Example 78 | 93 | 7.4 | 3.7 | 25 | $P_2O_5$—ZnO—$R_2O$—$Al_2O_3$ | 40 | Nanocrystal | 49 | 227 |

TABLE 9

| | Coating part | | | | | | | Dust core | |
|---|---|---|---|---|---|---|---|---|---|
| | Sz (nm) | Sa (nm) | Sz/T | Thickness T (nm) | Material | Amount of Soft $Bi_2O_3$ contained (wt %) | magnetic metal Structure | Strength (MPa) | Withstand voltage (V/mm) |
| Example 79 | 78 | 6.7 | 3.3 | 24 | $Bi_2O_3$—ZnO—$B_2O_3$—$SiO_2$ | 60 | Nanocrystal | 48 | 253 |
| Example 80 | 85 | 7.8 | 3.7 | 23 | $Bi_2O_3$—ZnO—$B_2O_3$—$SiO_2$ | 50 | Nanocrystal | 51 | 234 |
| Example 81 | 87 | 8.4 | 3.6 | 24 | $Bi_2O_3$—ZnO—$B_2O_3$—$SiO_2$ | 40 | Nanocrystal | 44 | 217 |

TABLE 10

| | Coating part | | | | | | | | Dust core | |
|---|---|---|---|---|---|---|---|---|---|---|
| | Sz (nm) | Sa (nm) | Sz/T | Thickness T (nm) | Material | Amount of $B_2O_3$ contained (wt %) | Amount of Soft $SiO_2$ contained (wt %) | magnetic metal Structure | Strength (MPa) | Withstand voltage (V/mm) |
| Example 82 | 95 | 8.7 | 3.7 | 26 | BaO—ZnO—$B_2O_3$—$SiO_2$—$Al_2O_3$ | 15 | 15 | Nanocrystal | 56 | 267 |
| Example 83 | 82 | 7.9 | 3.4 | 24 | BaO—ZnO—$B_2O_3$—$SiO_2$—$Al_2O_3$ | 10 | 10 | Nanocrystal | 53 | 249 |
| Example 84 | 92 | 9.5 | 3.7 | 25 | BaO—ZnO—$B_2O_3$—$SiO_2$—$Al_2O_3$ | 5 | 5 | Nanocrystal | 58 | 237 |

From Tables 8 to 10, in addition to a case where the surface roughness was within the above-described range, in a case where oxide glass was the above-described glass, and in a case where the composition of the oxide glass was within the above-described range, it could be confirmed that both the strength and the withstand voltage property of the dust core were compatible at a high level.

Experiment 6

A soft magnetic metal powder was manufactured by the same method as in Example 36 of Experiment 1 except that the composition of the soft magnetic metal was set to compositions shown in Tables 11 and 12, and the same evaluation as in Experiment 1 was performed. In addition, a dust core was manufactured by the same method as in Experiment 1 by using the obtained powder, and the same experiment as in Experiment 1 was performed. The results are shown in Tables 11 and 12. Note that, in Examples 85 to 142, the soft magnetic metal was an amorphous alloy, and the average crystal grain size of the initial fine crystals was 0.3 to 10 nm. In addition, the material of the powder-shaped coating material was the same as in Example 1.

TABLE 11

| | Coating part | | | | $Fe_{(1-(\alpha+\beta+a+b+c+d+e+f))}M_aB_bP_cSi_dC_eS_f$ ($\alpha = \beta = 0$) | | | | | | | Dust core | |
|---|---|---|---|---|---|---|---|---|---|---|---|---|---|
| | Sz (nm) | Sa (nm) | Sz/T | Thickness T (nm) | Fe | M(Nb) a | B b | P c | Si d | C e | S f | Strength (MPa) | Withstand voltage (V/mm) |
| Example 85 | 138 | 12.9 | 5.8 | 24 | 0.890 | 0.000 | 0.080 | 0.020 | 0.010 | 0.000 | 0.0000 | 65 | 292 |
| Example 86 | 125 | 12.3 | 4.8 | 26 | 0.790 | 0.100 | 0.080 | 0.020 | 0.010 | 0.000 | 0.0000 | 62 | 286 |
| Example 87 | 124 | 12.5 | 5.0 | 25 | 0.690 | 0.200 | 0.080 | 0.020 | 0.010 | 0.000 | 0.0000 | 66 | 292 |
| Example 88 | 117 | 11.3 | 4.7 | 25 | 0.590 | 0.300 | 0.080 | 0.020 | 0.010 | 0.000 | 0.0000 | 52 | 273 |
| Example 89 | 127 | 13.2 | 5.3 | 24 | 0.910 | 0.060 | 0.000 | 0.020 | 0.010 | 0.000 | 0.0000 | 67 | 287 |
| Example 90 | 125 | 12.2 | 5.0 | 25 | 0.710 | 0.060 | 0.200 | 0.020 | 0.010 | 0.000 | 0.0000 | 68 | 289 |
| Example 91 | 124 | 10.7 | 4.4 | 28 | 0.610 | 0.060 | 0.300 | 0.020 | 0.010 | 0.000 | 0.0000 | 64 | 286 |
| Example 92 | 124 | 10.7 | 4.4 | 28 | 0.510 | 0.060 | 0.400 | 0.020 | 0.010 | 0.000 | 0.0000 | 53 | 274 |
| Example 93 | 134 | 12.6 | 5.2 | 26 | 0.850 | 0.060 | 0.080 | 0.000 | 0.010 | 0.000 | 0.0000 | 61 | 285 |
| Example 94 | 116 | 12.6 | 4.8 | 24 | 0.650 | 0.060 | 0.080 | 0.200 | 0.010 | 0.000 | 0.0000 | 56 | 279 |
| Example 95 | 123 | 11.4 | 4.9 | 25 | 0.550 | 0.060 | 0.080 | 0.300 | 0.010 | 0.000 | 0.0000 | 57 | 280 |
| Example 96 | 123 | 11.4 | 4.9 | 25 | 0.450 | 0.060 | 0.080 | 0.400 | 0.010 | 0.000 | 0.0000 | 48 | 271 |
| Example 97 | 119 | 12.8 | 5.2 | 23 | 0.840 | 0.060 | 0.080 | 0.020 | 0.000 | 0.000 | 0.0000 | 64 | 281 |
| Example 98 | 126 | 10.4 | 5.3 | 24 | 0.640 | 0.060 | 0.080 | 0.020 | 0.200 | 0.000 | 0.0000 | 65 | 283 |
| Example 99 | 131 | 12.6 | 5.2 | 25 | 0.540 | 0.060 | 0.080 | 0.020 | 0.300 | 0.000 | 0.0000 | 62 | 285 |
| Example 100 | 131 | 12.6 | 5.2 | 25 | 0.440 | 0.060 | 0.080 | 0.020 | 0.400 | 0.000 | 0.0000 | 51 | 274 |
| Example 101 | 124 | 11.3 | 5.2 | 24 | 0.830 | 0.060 | 0.080 | 0.020 | 0.010 | 0.000 | 0.0000 | 58 | 281 |
| Example 102 | 118 | 11.6 | 5.1 | 23 | 0.630 | 0.060 | 0.080 | 0.020 | 0.010 | 0.200 | 0.0000 | 62 | 285 |
| Example 103 | 125 | 12.5 | 5.0 | 25 | 0.530 | 0.060 | 0.080 | 0.020 | 0.010 | 0.300 | 0.0000 | 63 | 284 |
| Example 104 | 127 | 12.4 | 5.1 | 25 | 0.430 | 0.060 | 0.080 | 0.020 | 0.010 | 0.400 | 0.0000 | 49 | 276 |
| Example 105 | 132 | 12.8 | 5.5 | 24 | 0.830 | 0.060 | 0.080 | 0.020 | 0.010 | 0.000 | 0.0000 | 57 | 282 |
| Example 106 | 125 | 12.3 | 5.7 | 22 | 0.810 | 0.060 | 0.080 | 0.020 | 0.010 | 0.000 | 0.0200 | 62 | 286 |
| Example 107 | 122 | 12.5 | 4.7 | 26 | 0.800 | 0.060 | 0.080 | 0.020 | 0.010 | 0.000 | 0.0300 | 63 | 284 |
| Example 108 | 122 | 12.5 | 4.7 | 26 | 0.790 | 0.060 | 0.080 | 0.020 | 0.010 | 0.000 | 0.0400 | 51 | 275 |

TABLE 12

| | Coating part | | | | $(Fe_{(1-(\alpha+\beta))}X1_{\alpha}X2_{\beta})_{0.750}B_{0.150}Si_{0.100}$ | | | | Dust core | |
|---|---|---|---|---|---|---|---|---|---|---|
| | | | | | X1 | | X2 | | | |
| | Sz (nm) | Sa (nm) | Sz/T | Thickness T (nm) | Element | (atomic number ratio) 0.750 × α | Element | (atomic number ratio) 0.750 β β | Strength (MPa) | Withstand voltage (V/mm) |
| Example 109 | 123 | 12.3 | 5.1 | 24 | — | 0.0000 | — | 0.0000 | 62 | 283 |
| Example 110 | 125 | 12.6 | 5.2 | 24 | Co | 0.2000 | — | 0.0000 | 63 | 285 |
| Example 111 | 127 | 12.4 | 4.7 | 27 | Co | 0.5000 | — | 0.0000 | 61 | 284 |
| Example 112 | 118 | 11.5 | 4.5 | 26 | Co | 0.7000 | — | 0.0000 | 56 | 277 |
| Example 113 | 124 | 12.1 | 5.0 | 25 | Ni | 0.2000 | — | 0.0000 | 61 | 285 |
| Example 114 | 135 | 11.3 | 5.4 | 25 | Ni | 0.5000 | — | 0.0000 | 57 | 284 |
| Example 115 | 125 | 11.6 | 5.2 | 24 | Ni | 0.7000 | — | 0.0000 | 53 | 281 |
| Example 116 | 116 | 11.7 | 4.5 | 26 | — | 0.0000 | Al | 0.0200 | 63 | 284 |
| Example 117 | 123 | 12.3 | 4.9 | 25 | — | 0.0000 | Al | 0.0400 | 58 | 284 |
| Example 118 | 125 | 12.7 | 4.8 | 26 | — | 0.0000 | Al | 0.0600 | 57 | 279 |
| Example 119 | 113 | 11.8 | 4.0 | 28 | — | 0.0000 | Zn | 0.0200 | 64 | 282 |
| Example 120 | 124 | 10.1 | 5.2 | 24 | — | 0.0000 | Zn | 0.0400 | 63 | 283 |
| Example 121 | 127 | 12.7 | 5.8 | 22 | — | 0.0000 | Zn | 0.0600 | 59 | 278 |
| Example 122 | 128 | 11.2 | 4.4 | 29 | — | 0.0000 | Sn | 0.0200 | 63 | 283 |
| Example 123 | 123 | 11.8 | 4.9 | 25 | — | 0.0000 | Sn | 0.0400 | 62 | 282 |
| Example 124 | 126 | 12.5 | 5.3 | 24 | — | 0.0000 | Sn | 0.0600 | 55 | 275 |
| Example 125 | 128 | 12.5 | 4.6 | 28 | — | 0.0000 | Cu | 0.0200 | 63 | 284 |
| Example 126 | 123 | 12.7 | 5.3 | 23 | — | 0.0000 | Cu | 0.0400 | 62 | 283 |
| Example 127 | 121 | 12.4 | 4.5 | 27 | — | 0.0000 | Cu | 0.0600 | 57 | 278 |
| Example 128 | 123 | 12.4 | 4.6 | 27 | — | 0.0000 | Cr | 0.0200 | 64 | 285 |
| Example 129 | 127 | 10.7 | 5.1 | 25 | — | 0.0000 | Cr | 0.0400 | 63 | 283 |
| Example 130 | 128 | 13.6 | 5.1 | 25 | — | 0.0000 | Cr | 0.0600 | 58 | 277 |
| Example 131 | 113 | 11.3 | 4.7 | 24 | — | 0.0000 | Bi | 0.0200 | 62 | 282 |
| Example 132 | 125 | 12.9 | 4.8 | 26 | — | 0.0000 | Bi | 0.0400 | 63 | 285 |
| Example 133 | 125 | 12.4 | 4.8 | 26 | — | 0.0000 | Bi | 0.0600 | 59 | 281 |
| Example 134 | 124 | 12.3 | 4.6 | 27 | — | 0.0000 | La | 0.0200 | 64 | 285 |
| Example 135 | 126 | 12.8 | 5.0 | 25 | — | 0.0000 | La | 0.0400 | 63 | 283 |
| Example 136 | 124 | 12.6 | 5.2 | 24 | — | 0.0000 | La | 0.0600 | 57 | 279 |
| Example 137 | 125 | 11.8 | 5.2 | 24 | — | 0.0000 | Y | 0.0200 | 64 | 284 |
| Example 138 | 123 | 13.6 | 4.9 | 25 | — | 0.0000 | Y | 0.0400 | 62 | 282 |
| Example 139 | 124 | 11.5 | 4.8 | 26 | — | 0.0000 | Y | 0.0600 | 56 | 276 |
| Example 140 | 127 | 12.1 | 5.3 | 24 | — | 0.0000 | O | 0.0200 | 63 | 283 |
| Example 141 | 118 | 12.6 | 5.1 | 23 | — | 0.0000 | O | 0.0400 | 63 | 284 |
| Example 142 | 123 | 10.6 | 4.9 | 25 | — | 0.0000 | O | 0.0600 | 58 | 278 |

Experiment 7

A soft magnetic metal powder was manufactured by the same method as in Example 1 of Experiment 1 except that the composition of the soft magnetic metal was set to compositions shown in Tables 13 to 15, and the same evaluation as in Experiment 1 was performed. In addition, a dust core was manufactured by the same method as in Experiment 1 by using the obtained powder, and the same evaluation as in Experiment 1 was performed. The results are shown in Tables 13 to 15. Note that, in Examples 143 to 208, the soft magnetic metal was a nanocrystalline alloy, and the average crystal grain size of the nanocrystal was 5 to 30 nm. In addition, the material of the powder-shaped coating material was the same as in Example 1.

TABLE 13

| | Coating part | | | | $Fe_{(1-(a+b+c+d+e+f))}M_aB_bP_cSi_dC_eS_f$ ($\alpha = \beta = 0$) | | | | | | | Dust core | |
|---|---|---|---|---|---|---|---|---|---|---|---|---|---|
| | Sz (nm) | Sa (nm) | Sz/T | Thickness T (nm) | Fe | M(Nb) a | B b | P c | Si d | C e | S f | Strength (MPa) | Withstand voltage (V/mm) |
| Example 143 | 123 | 12.0 | 5.1 | 24 | 0.870 | 0.000 | 0.080 | 0.030 | 0.020 | 0.000 | 0.0000 | 62 | 285 |
| Example 144 | 136 | 11.3 | 5.2 | 26 | 0.770 | 0.100 | 0.080 | 0.030 | 0.020 | 0.000 | 0.0000 | 67 | 293 |
| Example 145 | 117 | 10.7 | 5.1 | 23 | 0.670 | 0.200 | 0.080 | 0.030 | 0.020 | 0.000 | 0.0000 | 63 | 287 |
| Example 146 | 127 | 12.4 | 5.1 | 25 | 0.570 | 0.300 | 0.080 | 0.030 | 0.020 | 0.000 | 0.0000 | 56 | 282 |
| Example 147 | 135 | 13.7 | 5.6 | 24 | 0.890 | 0.060 | 0.000 | 0.030 | 0.020 | 0.000 | 0.0000 | 59 | 286 |
| Example 148 | 124 | 11.4 | 5.0 | 25 | 0.690 | 0.060 | 0.200 | 0.030 | 0.020 | 0.000 | 0.0000 | 64 | 291 |
| Example 149 | 142 | 13.6 | 5.5 | 26 | 0.590 | 0.060 | 0.300 | 0.030 | 0.020 | 0.000 | 0.0000 | 58 | 286 |
| Example 150 | 121 | 11.8 | 4.7 | 26 | 0.490 | 0.060 | 0.400 | 0.030 | 0.020 | 0.000 | 0.0000 | 54 | 283 |
| Example 151 | 126 | 13.2 | 5.3 | 24 | 0.840 | 0.060 | 0.080 | 0.000 | 0.020 | 0.000 | 0.0000 | 62 | 286 |
| Example 152 | 123 | 11.4 | 4.9 | 25 | 0.640 | 0.060 | 0.080 | 0.200 | 0.020 | 0.000 | 0.0000 | 63 | 289 |
| Example 153 | 116 | 10.2 | 4.6 | 25 | 0.540 | 0.060 | 0.080 | 0.300 | 0.020 | 0.000 | 0.0000 | 61 | 286 |
| Example 154 | 117 | 10.6 | 4.9 | 24 | 0.440 | 0.060 | 0.080 | 0.400 | 0.020 | 0.000 | 0.0000 | 57 | 282 |
| Example 155 | 113 | 9.5 | 4.9 | 23 | 0.830 | 0.060 | 0.080 | 0.030 | 0.000 | 0.000 | 0.0000 | 63 | 285 |
| Example 156 | 131 | 11.4 | 6.0 | 22 | 0.630 | 0.060 | 0.080 | 0.030 | 0.200 | 0.000 | 0.0000 | 64 | 288 |

TABLE 13-continued

| | Coating part | | | | $Fe_{(1-(a+b+c+d+e+f))}M_aB_bP_cSi_dC_eS_f$ ($\alpha = \beta = 0$) | | | | | | | Dust core | |
|---|---|---|---|---|---|---|---|---|---|---|---|---|---|
| | Sz (nm) | Sa (nm) | Sz/T | Thickness T (nm) | Fe | M(Nb) a | B b | P c | Si d | C e | S f | Strength (MPa) | Withstand voltage (V/mm) |
| Example 157 | 116 | 12.4 | 5.0 | 23 | 0.530 | 0.060 | 0.080 | 0.030 | 0.300 | 0.000 | 0.0000 | 62 | 287 |
| Example 158 | 124 | 12.9 | 5.4 | 23 | 0.430 | 0.060 | 0.080 | 0.030 | 0.400 | 0.000 | 0.0000 | 58 | 281 |
| Example 159 | 127 | 9.8 | 5.3 | 24 | 0.810 | 0.060 | 0.080 | 0.030 | 0.020 | 0.000 | 0.0000 | 67 | 286 |
| Example 160 | 126 | 11.3 | 5.5 | 23 | 0.610 | 0.060 | 0.080 | 0.030 | 0.020 | 0.200 | 0.0000 | 67 | 291 |
| Example 161 | 131 | 12.8 | 5.0 | 26 | 0.510 | 0.060 | 0.080 | 0.030 | 0.020 | 0.300 | 0.0000 | 63 | 285 |
| Example 162 | 127 | 13.4 | 4.9 | 26 | 0.410 | 0.060 | 0.080 | 0.030 | 0.020 | 0.400 | 0.0000 | 56 | 280 |
| Example 163 | 125 | 10.4 | 5.2 | 24 | 0.810 | 0.060 | 0.080 | 0.030 | 0.020 | 0.000 | 0.0000 | 63 | 285 |
| Example 164 | 129 | 13.4 | 5.0 | 26 | 0.790 | 0.060 | 0.080 | 0.030 | 0.020 | 0.000 | 0.0200 | 65 | 293 |
| Example 165 | 134 | 11.5 | 5.4 | 25 | 0.780 | 0.060 | 0.080 | 0.030 | 0.020 | 0.000 | 0.0300 | 64 | 286 |
| Example 166 | 124 | 12.6 | 5.6 | 22 | 0.770 | 0.060 | 0.080 | 0.030 | 0.020 | 0.000 | 0.0400 | 59 | 282 |

TABLE 14

| | Coating part | | | | | Dust core | |
|---|---|---|---|---|---|---|---|
| | Sz (nm) | Sa (nm) | Sz/T | Thickness T (nm) | $Fe_{0.810}M_{0.060}B_{0.080}P_{0.050}$ M | Strength (MPa) | Withstand voltage (V/mm) |
| Example 167 | 113 | 9.5 | 4.9 | 23 | Nb | 63 | 284 |
| Example 168 | 123 | 10.3 | 4.9 | 25 | Hf | 62 | 285 |
| Example 169 | 121 | 11.6 | 4.7 | 26 | Zr | 63 | 284 |
| Example 170 | 116 | 10.2 | 4.6 | 25 | Ta | 64 | 283 |
| Example 171 | 132 | 9.7 | 5.7 | 23 | Mo | 62 | 285 |
| Example 172 | 124 | 11.4 | 4.6 | 27 | W | 63 | 283 |
| Example 173 | 127 | 13.4 | 5.3 | 24 | V | 62 | 284 |
| Example 174 | 135 | 12.2 | 5.2 | 26 | Ti | 64 | 285 |

35

TABLE 15

| | Coating part | | | | $(Fe_{(1-(\alpha+\beta))}X1_\alpha X2_\beta)_{0.810}M_{0.070}B_{0.090}P_{0.030}$ | | | | Dust core | |
|---|---|---|---|---|---|---|---|---|---|---|
| | | | | | X1 | | X2 | | | |
| | Sz (nm) | Sa (nm) | Sz/T | Thickness T (nm) | Element | (atomic number ratio) $0.810 \times \alpha$ | Element | (atomic number ratio) $0.810 \times \beta$ | Strength (MPa) | Withstand voltage (V/mm) |
| Example 175 | 113 | 9.5 | 4.9 | 23 | — | 0.0000 | — | 0.0000 | 61 | 284 |
| Example 176 | 125 | 11.5 | 5.0 | 25 | Co | 0.2000 | — | 0.0000 | 59 | 287 |
| Example 177 | 131 | 10.6 | 5.7 | 23 | Co | 0.5000 | — | 0.0000 | 59 | 286 |
| Example 178 | 123 | 12.7 | 4.7 | 26 | Co | 0.7000 | — | 0.0000 | 54 | 282 |
| Example 179 | 123 | 13.6 | 5.6 | 22 | Ni | 0.2000 | — | 0.0000 | 57 | 285 |
| Example 180 | 129 | 12.3 | 5.0 | 26 | Ni | 0.5000 | — | 0.0000 | 58 | 287 |
| Example 181 | 122 | 12.5 | 4.5 | 27 | Ni | 0.7000 | — | 0.0000 | 53 | 283 |
| Example 182 | 124 | 11.2 | 4.8 | 26 | — | 0.0000 | Al | 0.0200 | 63 | 285 |
| Example 183 | 126 | 12.7 | 5.3 | 24 | — | 0.0000 | Al | 0.0400 | 64 | 286 |
| Example 184 | 132 | 12.6 | 5.5 | 24 | — | 0.0000 | Al | 0.0600 | 55 | 282 |
| Example 185 | 124 | 11.7 | 4.8 | 26 | — | 0.0000 | Zn | 0.0200 | 63 | 286 |
| Example 186 | 138 | 10.9 | 5.5 | 25 | — | 0.0000 | Zn | 0.0400 | 62 | 288 |
| Example 187 | 123 | 12.5 | 4.6 | 27 | — | 0.0000 | Zn | 0.0600 | 54 | 279 |
| Example 188 | 116 | 12.7 | 4.6 | 25 | — | 0.0000 | Sn | 0.0200 | 63 | 285 |
| Example 189 | 124 | 12.3 | 5.4 | 23 | — | 0.0000 | Sn | 0.0400 | 63 | 289 |
| Example 190 | 127 | 12.6 | 5.5 | 23 | — | 0.0000 | Sn | 0.0600 | 52 | 281 |
| Example 191 | 132 | 12.8 | 5.5 | 24 | — | 0.0000 | Cu | 0.0200 | 64 | 284 |
| Example 192 | 125 | 12.2 | 4.8 | 26 | — | 0.0000 | Cu | 0.0400 | 62 | 288 |
| Example 193 | 121 | 11.4 | 4.5 | 27 | — | 0.0000 | Cu | 0.0600 | 54 | 282 |
| Example 194 | 116 | 12.3 | 4.5 | 26 | — | 0.0000 | Cr | 0.0200 | 62 | 284 |
| Example 195 | 112 | 12.6 | 4.1 | 27 | — | 0.0000 | Cr | 0.0400 | 63 | 285 |
| Example 196 | 123 | 10.7 | 4.7 | 26 | — | 0.0000 | Cr | 0.0600 | 56 | 278 |
| Example 197 | 123 | 12.8 | 4.7 | 26 | — | 0.0000 | Bi | 0.0200 | 63 | 283 |
| Example 198 | 115 | 11.6 | 4.6 | 25 | — | 0.0000 | Bi | 0.0400 | 63 | 284 |

TABLE 15-continued

| | Coating part | | | | $(Fe_{(1-(\alpha+\beta))}X1_{\alpha}X2_{\beta})_{0.810}M_{0.070}B_{0.090}P_{0.030}$ | | | | Dust core | |
|---|---|---|---|---|---|---|---|---|---|---|
| | | | | | X1 | | X2 | | | |
| | Sz (nm) | Sa (nm) | Sz/T | Thickness T (nm) | Element | (atomic number ratio) 0.810 × α | Element | (atomic number ratio) 0.810 × β | Strength (MPa) | Withstand voltage (V/mm) |
| Example 199 | 136 | 13.1 | 5.7 | 24 | — | 0.0000 | Bi | 0.0600 | 52 | 277 |
| Example 200 | 121 | 12.3 | 4.8 | 25 | — | 0.0000 | La | 0.0200 | 62 | 284 |
| Example 201 | 123 | 12.1 | 5.1 | 24 | — | 0.0000 | La | 0.0400 | 63 | 287 |
| Example 202 | 134 | 11.2 | 5.8 | 23 | — | 0.0000 | La | 0.0600 | 52 | 281 |
| Example 203 | 129 | 11.3 | 5.4 | 24 | — | 0.0000 | Y | 0.0200 | 63 | 285 |
| Example 204 | 114 | 13.5 | 4.4 | 26 | — | 0.0000 | Y | 0.0400 | 64 | 284 |
| Example 205 | 128 | 12.8 | 4.9 | 26 | — | 0.0000 | Y | 0.0600 | 54 | 278 |
| Example 206 | 126 | 12.5 | 5.3 | 24 | — | 0.0000 | O | 0.0200 | 63 | 283 |
| Example 207 | 135 | 13.6 | 5.0 | 27 | — | 0.0000 | O | 0.0400 | 64 | 285 |
| Example 208 | 127 | 11.6 | 4.9 | 26 | — | 0.0000 | O | 0.0600 | 53 | 277 |

From Tables 11 to 15, in addition to a case where the surface roughness was within the above-described range, in a case where the composition of the soft magnetic metal was within the above-described range, it could be confirmed that both the strength and the withstand voltage property of the dust core were compatible with each other at a high level.

Experiment 8

A soft magnetic metal powder was manufactured by the same method as in Example 38 of Experiment 2 except that the number ratio of the coated particles was set to values shown in Table 16, and the same evaluation as in Experiment 2 was performed. That is, Rz and Ra were calculated. In addition, a dust core was manufactured by the same method as in Experiment 1 by using the obtained powder, and the same evaluation as in Experiment 1 was performed. The results are shown in Table 16.

Moreover, a soft magnetic metal powder was manufactured by the same method as in Example 38 of Experiment 2 except that the average circularity of the soft magnetic metal particles was set to values shown in Table 17, and the same evaluation as in Experiment 2 was performed. In addition, a dust core was manufactured by the same method as in Experiment 1 by using the obtained powder, and the same evaluation as in Experiment 1 was performed. The results are shown in Table 17.

Furthermore, a soft magnetic metal powder was manufactured by the same method as in Example 38 of Experiment 2 except that the average particle diameter of the soft magnetic metal powder was set to values shown in Table 18, and the same evaluation as in Experiment 2 was performed. In addition, a dust core was manufactured by the same method as in Experiment 1 by using the obtained powder, and the same evaluation as in Experiment 1 was performed. The results are shown in Table 18. Note that, in Examples 229 to 239, the composition of the soft magnetic metal, and the material of the powder-shaped coating material were the same as in Example 38.

TABLE 16

| | Coating part | | | | | Soft magnetic metal Structure | Coated particle Number ratio of coated particle (%) | Dust core Strength (MPa) | Withstand voltage (V/mm) |
|---|---|---|---|---|---|---|---|---|---|
| | Rz (nm) | Ra (nm) | Rz/T | Thickness T (nm) | Material | | | | |
| Example 229 | 82 | 7.9 | 3.4 | 24 | $P_2O_5$—ZnO—$R_2O$—$Al_2O_3$ | Nanocrystal | 95 | 53 | 281 |
| Example 230 | 77 | 7.2 | 3.5 | 22 | $P_2O_5$—ZnO—$R_2O$—$Al_2O_3$ | Nanocrystal | 90 | 48 | 263 |
| Example 231 | 79 | 7.5 | 3.2 | 25 | $P_2O_5$—ZnO—$R_2O$—$Al_2O_3$ | Nanocrystal | 85 | 45 | 244 |

TABLE 17

| | Coating part | | | | | Soft magnetic metal | | Dust core | |
|---|---|---|---|---|---|---|---|---|---|
| | Rz (nm) | Ra (nm) | Rz/T | Thickness T (nm) | Material | Structure | Circularity | Strength (MPa) | Withstand voltage (V/mm) |
| Example 232 | 79 | 7.1 | 3.6 | 22 | $P_2O_5$—ZnO—$R_2O$—$Al_2O_3$ | Nanocrystal | 0.90 | 53 | 276 |
| Example 233 | 84 | 7.8 | 3.7 | 23 | $P_2O_5$—ZnO—$R_2O$—$Al_2O_3$ | Nanocrystal | 0.85 | 49 | 258 |
| Example 234 | 71 | 7.4 | 2.7 | 26 | $P_2O_5$—ZnO—$R_2O$—$Al_2O_3$ | Nanocrystal | 0.80 | 46 | 242 |

TABLE 18

| | Coating part | | | | | Soft magnetic metal | | Dust core | |
|---|---|---|---|---|---|---|---|---|---|
| | Rz (nm) | Ra (nm) | Rz/T | Thickness T (nm) | Material | Structure | Average particle size (μm) | Strength (MPa) | Withstand voltage (V/mm) |
| Example 235 | 105 | 9.1 | 4.0 | 26 | $P_2O_5$—ZnO—$R_2O$—$Al_2O_3$ | Nanocrystal | 0.1 | 22 | 351 |
| Example 236 | 87 | 7.6 | 4.1 | 21 | $P_2O_5$—ZnO—$R_2O$—$Al_2O_3$ | Nanocrystal | 0.3 | 36 | 337 |
| Example 237 | 79 | 7.3 | 3.4 | 23 | $P_2O_5$—ZnO—$R_2O$—$Al_2O_3$ | Nanocrystal | 26 | 53 | 275 |
| Example 238 | 68 | 6.5 | 2.7 | 25 | $P_2O_5$—ZnO—$R_2O$—$Al_2O_3$ | Nanocrystal | 99 | 32 | 226 |
| Example 239 | 71 | 6.7 | 3.1 | 23 | $P_2O_5$—ZnO—$R_2O$—$Al_2O_3$ | Nanocrystal | 146 | 25 | 192 |

From Tables 16 to 18, in addition to a case where the line roughness was within the above-described range, and in a case where the number ratio of the coated particles, the average circularity of the soft magnetic metal particles, and the average particle size of the soft magnetic metal powder were within the above-described ranges, it could be confirmed that both the strength and the withstand voltage property of the dust core were satisfactory.

Experiment 9

A soft magnetic metal powder was manufactured by the same method as in Example 227 of Experiment 2 except that the average crystal grain size of the initial fine crystals was set to values shown in Table 19, and the same evaluation as in Experiment 2 was performed. In addition, a dust core was manufactured by the same method as in Experiment 1 by using the obtained powder, and the same evaluation as in Experiment 1 was performed. The results are shown in Table 19. Note that, in Examples 240 to 244, the composition of the soft magnetic metal and the material of the powder-shaped coating material were the same as in Example 227.

Moreover, a soft magnetic metal powder was manufactured by the same method as in Example 38 of Experiment 2 except that the average crystal grain size of the nanocrystal was set to values shown in Table 20, and the same evaluation as in Experiment 2 was performed. In addition, a dust core was manufactured by the same method as in Experiment 1 by using the obtained powder, and the same evaluation as in Experiment 1 was performed. The results are shown in Table 20. Note that, in Examples 245 to 249, the composition of the soft magnetic metal and the material of the powder-shaped coating material were the same as in Example 38.

TABLE 19

| | Coating part | | | | | Soft magnetic metal | | Dust core | |
|---|---|---|---|---|---|---|---|---|---|
| | Rz (nm) | Ra (nm) | Rz/T | Thickness T (nm) | Material | Structure | Average crystal grain size of initial fine crystals (nm) | Strength (MPa) | Withstand voltage (V/mm) |
| Example 240 | 78 | 7.1 | 3.1 | 25 | $P_2O_5$—ZnO—$R_2O$—$Al_2O_3$ | Amorphous | 0.1 | 45 | 215 |
| Example 241 | 90 | 8.4 | 3.9 | 23 | $P_2O_5$—ZnO—$R_2O$—$Al_2O_3$ | Amorphous | 0.3 | 48 | 259 |
| Example 242 | 84 | 7.3 | 3.5 | 24 | $P_2O_5$—ZnO—$R_2O$—$Al_2O_3$ | Amorphous | 2 | 52 | 281 |
| Example 243 | 74 | 6.8 | 2.7 | 27 | $P_2O_5$—ZnO—$R_2O$—$Al_2O_3$ | Amorphous | 10 | 50 | 262 |
| Example 244 | 77 | 7.5 | 3.3 | 23 | $P_2O_5$—ZnO—$R_2O$—$Al_2O_3$ | Amorphous | 15 | 49 | 228 |

TABLE 20

| | Coating part | | | | | Soft magnetic metal | | Dust core | |
|---|---|---|---|---|---|---|---|---|---|
| | Rz (nm) | Ra (nm) | Rz/T | Thickness T (nm) | Material | Structure | Average crystal grain size of Nanocrystals (nm) | Strength (MPa) | Withstand voltage (V/mm) |
| Example 245 | 87 | 8.4 | 3.6 | 24 | $P_2O_5$—ZnO—$R_2O$—$Al_2O_3$ | Nanocrystal | 1 | 52 | 234 |
| Example 246 | 83 | 7.8 | 3.6 | 23 | $P_2O_5$—ZnO—$R_2O$—$Al_2O_3$ | Nanocrystal | 5 | 47 | 248 |
| Example 247 | 73 | 7.2 | 2.8 | 26 | $P_2O_5$—ZnO—$R_2O$—$Al_2O_3$ | Nanocrystal | 18 | 51 | 279 |
| Example 248 | 81 | 7.9 | 2.9 | 28 | $P_2O_5$—ZnO—$R_2O$—$Al_2O_3$ | Nanocrystal | 30 | 49 | 267 |
| Example 249 | 76 | 7.5 | 3.3 | 23 | $P_2O_5$—ZnO—$R_2O$—$Al_2O_3$ | Nanocrystal | 54 | 47 | 232 |

From Tables 19 and 20, in addition to a case where the line roughness was within the above-described range, in a case where the average crystal grain size of the initial fine crystals and the average crystal grain size of the nanocrystal were within the above-described ranges, it could be confirmed that both the strength and the withstand voltage property of the dust core were compatible with each other at a high level.

Experiment 10

A soft magnetic metal powder was manufactured by the same method as in Example 38 of Experiment 2 except that the amount of $P_2O_5$ in the $P_2O_5$—ZnO—$R_2O$—$Al_2O_3$ glass was set to values shown in Table 21, and the same evaluation as in Experiment 2 was performed. In addition, a dust core was manufactured by the same method as in Experiment 1 by using the obtained powder, and the same evaluation as in Experiment 1 was performed. The results are shown in Table 21. Note that, in Examples 250 to 252, the composition of the soft magnetic metal was the same as in Example 38.

Moreover, a soft magnetic metal powder was manufactured by the same method as in Example 38 of Experiment 2 except that the $P_2O_5$—ZnO—$R_2O$—$Al_2O_3$ glass was changed to $Bi_2O_3$—ZnO—$B_2O_3$—$SiO_2$ glass or BaO—ZnO—$B_2O_3$—$SiO_2$—$Al_2O_3$ glass, and the same evaluation as in Experiment 2 was performed. In addition, a dust core was manufactured by the same method as in Experiment 1 by using the obtained powder, and the same evaluation as in Experiment 1 was performed. The results are shown in Tables 22 and 23.

Note that, in Examples 253 to 258, the composition of the soft magnetic metal was the same as in Example 38. In Examples 253 to 255, in the composition of the $Bi_2O_3$—ZnO—$B_2O_3$—$SiO_2$ glass, $Bi_2O_3$ was 40% by mass to 60% by mass, ZnO was 10% by mass to 15% by mass, $B_2O_3$ was 15% by mass to 25% by mass, $SiO_2$ was 15% by mass to 20% by mass, and the remainder was a sub-component. In Example 256 to 258, in the composition of the BaO—ZnO—$B_2O_3$—$SiO_2$—$Al_2O_3$ glass, BaO was 35% by mass to 40% by mass, ZnO was 30% by mass to 40% by mass, $B_2O_3$ was 5% by mass to 15% by mass, $SiO_2$ was 5% by mass to 15% by mass, $Al_2O_3$ was 5% by mass to 10% by mass, and the remainder was a sub-component.

TABLE 21

| | Coating part | | | | | | | Dust core | |
|---|---|---|---|---|---|---|---|---|---|
| | Rz (nm) | Ra (nm) | Rz/T | Thickness T (nm) | Material | Amount of $P_2O_5$ contained (wt %) | Soft magnetic metal Structure | Strength (MPa) | Withstand voltage (V/mm) |
| Example 250 | 82 | 9.3 | 3.2 | 26 | $P_2O_5$—ZnO—$R_2O$—$Al_2O_3$ | 60 | Nanocrystal | 52 | 266 |
| Example 251 | 77 | 8.3 | 3.3 | 23 | $P_2O_5$—ZnO—$R_2O$—$Al_2O_3$ | 50 | Nanocrystal | 51 | 239 |
| Example 252 | 84 | 7.1 | 3.8 | 22 | $P_2O_5$—ZnO—$R_2O$—$Al_2O_3$ | 40 | Nanocrystal | 47 | 214 |

TABLE 22

| | Coating part | | | | | | | Dust core | |
|---|---|---|---|---|---|---|---|---|---|
| | Rz (nm) | Ra (nm) | Rz/T | Thickness T (nm) | Material | Amount of $Bi_2O_3$ contained (wt %) | Soft magnetic metal Structure | Strength (MPa) | Withstand voltage (V/mm) |
| Example 253 | 73 | 7.1 | 3.2 | 23 | $Bi_2O_3$—ZnO—$B_2O_3$—$SiO_2$ | 60 | Nanocrystal | 47 | 262 |
| Example 254 | 79 | 7.4 | 3.3 | 24 | $Bi_2O_3$—ZnO—$B_2O_3$—$SiO_2$ | 50 | Nanocrystal | 53 | 237 |
| Example 255 | 84 | 7.7 | 3.5 | 24 | $Bi_2O_3$—ZnO—$B_2O_3$—$SiO_2$ | 40 | Nanocrystal | 41 | 221 |

TABLE 23

| | Coating part | | | | | | | | Dust core | |
|---|---|---|---|---|---|---|---|---|---|---|
| | Rz (nm) | Ra (nm) | Rz/T | Thickness T (nm) | Material | Amount of $B_2O_3$ contained (wt %) | Amount of $SiO_2$ contained (wt %) | Soft magnetic metal Structure | Strength (MPa) | Withstand voltage (V/mm) |
| Example 256 | 82 | 8.5 | 3.7 | 22 | BaO—ZnO—$B_2O_3$—$SiO_2$—$Al_2O_3$ | 15 | 15 | Nanocrystal | 54 | 272 |
| Example 257 | 74 | 7.4 | 2.8 | 26 | BaO—ZnO—$B_2O_3$—$SiO_2$—$Al_2O_3$ | 10 | 10 | Nanocrystal | 55 | 247 |
| Example 258 | 86 | 8.8 | 3.7 | 23 | BaO—ZnO—$B_2O_3$—$SiO_2$—$Al_2O_3$ | 5 | 5 | Nanocrystal | 53 | 229 |

From Tables 21 to 23, in addition to a case where the line roughness was within the above-described range, in a case where the oxide glass was the above-described glass, and the composition of the oxide glass was within the above-described range, in could be confirmed that both the strength and the withstand voltage property of the dust core were compatible at a high level.

Experiment 11

A soft magnetic metal powder was manufactured by the same method as in Example 227 of Experiment 2 except that the composition of the soft magnetic metal was set to compositions shown in Tables 24 and 25, and the same evaluation as in Experiment 2 was performed. In addition, a dust core was manufactured by the same method as in Experiment 1 by using the obtained powder, and the same evaluation as in Experiment 1 was performed. The results are shown in Tables 24 and 25. Note that, in Examples 259 to 316, the soft magnetic metal was an amorphous alloy, and the average crystal grain size of the initial fine crystals was 0.3 to 10 nm. Moreover, the material of the powder-shaped coating material was the same as in Example 227.

TABLE 24

| | Coating part | | | | | | | | | | | Dust core | |
|---|---|---|---|---|---|---|---|---|---|---|---|---|---|
| | | | | Thickness | $Fe_{(1-(a+b+c+d+e+f))}M_aB_bP_cSi_dC_eS_f$ ($\alpha = \beta = 0$) | | | | | | | | Withstand |
| | Rz (nm) | Ra (nm) | Rz/T | T (nm) | Fe | M (Nb) a | B b | P c | Si d | C e | S f | Strength (MPa) | voltage (V/mm) |
| Example 259 | 125 | 11.6 | 4.8 | 26 | 0.890 | 0.000 | 0.080 | 0.020 | 0.010 | 0.000 | 0.0000 | 64 | 288 |
| Example 260 | 117 | 11.8 | 4.9 | 24 | 0.790 | 0.100 | 0.080 | 0.020 | 0.010 | 0.000 | 0.0000 | 66 | 291 |
| Example 261 | 118 | 11.4 | 5.1 | 23 | 0.690 | 0.200 | 0.080 | 0.020 | 0.010 | 0.000 | 0.0000 | 61 | 285 |
| Example 262 | 106 | 10.5 | 4.4 | 24 | 0.590 | 0.300 | 0.080 | 0.020 | 0.010 | 0.000 | 0.0000 | 57 | 281 |
| Example 263 | 122 | 12.3 | 4.9 | 25 | 0.910 | 0.060 | 0.000 | 0.020 | 0.010 | 0.000 | 0.0000 | 66 | 287 |
| Example 264 | 114 | 11.6 | 4.4 | 26 | 0.710 | 0.060 | 0.200 | 0.020 | 0.010 | 0.000 | 0.0000 | 67 | 288 |
| Example 265 | 119 | 9.6 | 4.4 | 27 | 0.610 | 0.060 | 0.300 | 0.020 | 0.010 | 0.000 | 0.0000 | 63 | 284 |
| Example 266 | 116 | 10.1 | 4.5 | 26 | 0.510 | 0.060 | 0.400 | 0.020 | 0.010 | 0.000 | 0.0000 | 56 | 275 |
| Example 267 | 127 | 12.2 | 5.3 | 24 | 0.850 | 0.060 | 0.080 | 0.000 | 0.010 | 0.000 | 0.0000 | 61 | 283 |
| Example 268 | 109 | 11.3 | 4.7 | 23 | 0.650 | 0.060 | 0.080 | 0.200 | 0.010 | 0.000 | 0.0000 | 62 | 284 |
| Example 269 | 115 | 10.3 | 4.4 | 26 | 0.550 | 0.060 | 0.080 | 0.300 | 0.010 | 0.000 | 0.0000 | 57 | 279 |
| Example 270 | 121 | 11.2 | 5.0 | 24 | 0.450 | 0.060 | 0.080 | 0.400 | 0.010 | 0.000 | 0.0000 | 52 | 273 |
| Example 271 | 117 | 11.4 | 5.3 | 22 | 0.840 | 0.060 | 0.080 | 0.020 | 0.000 | 0.000 | 0.0000 | 63 | 282 |
| Example 272 | 123 | 9.8 | 4.9 | 25 | 0.640 | 0.060 | 0.080 | 0.020 | 0.200 | 0.000 | 0.0000 | 64 | 283 |
| Example 273 | 125 | 11.2 | 5.4 | 23 | 0.540 | 0.060 | 0.080 | 0.020 | 0.300 | 0.000 | 0.0000 | 62 | 281 |
| Example 274 | 124 | 11.6 | 4.8 | 26 | 0.440 | 0.060 | 0.080 | 0.020 | 0.400 | 0.000 | 0.0000 | 54 | 275 |
| Example 275 | 113 | 10.8 | 4.9 | 23 | 0.830 | 0.060 | 0.080 | 0.020 | 0.010 | 0.000 | 0.0000 | 58 | 284 |
| Example 276 | 115 | 10.2 | 4.8 | 24 | 0.630 | 0.060 | 0.080 | 0.020 | 0.010 | 0.200 | 0.0000 | 61 | 287 |
| Example 277 | 125 | 10.8 | 5.4 | 23 | 0.530 | 0.060 | 0.080 | 0.020 | 0.010 | 0.300 | 0.0000 | 59 | 281 |
| Example 278 | 122 | 11.8 | 4.9 | 25 | 0.430 | 0.060 | 0.080 | 0.020 | 0.010 | 0.400 | 0.0000 | 51 | 274 |
| Example 279 | 129 | 11.5 | 5.6 | 23 | 0.830 | 0.060 | 0.080 | 0.020 | 0.010 | 0.000 | 0.0000 | 62 | 285 |
| Example 280 | 119 | 11.3 | 5.0 | 24 | 0.810 | 0.060 | 0.080 | 0.020 | 0.010 | 0.000 | 0.0200 | 63 | 287 |
| Example 281 | 118 | 12.2 | 4.4 | 27 | 0.800 | 0.060 | 0.080 | 0.020 | 0.010 | 0.000 | 0.0300 | 60 | 283 |
| Example 282 | 114 | 11.4 | 4.6 | 25 | 0.790 | 0.060 | 0.080 | 0.020 | 0.010 | 0.000 | 0.0400 | 52 | 274 |

TABLE 25

| | Coating part | | | | $(Fe_{(1-(\alpha+\beta))}X1_\alpha X2_\beta)_{0.750}B_{0.150}Si_{0.100}$ | | | | Dust core | |
|---|---|---|---|---|---|---|---|---|---|---|
| | | | | Thickness | X1 (atomic number ratio) | | X2 (atomic number ratio) | | | Withstand |
| | Rz | Ra | | T | | | | | Strength | voltage |
| | (nm) | (nm) | Rz/T | (nm) | Element | $0.750 \times \alpha$ | Element | $0.750 \times \beta$ | (MPa) | (V/mmm) |
| Example 283 | 118 | 10.3 | 4.9 | 24 | — | 0.0000 | — | 0.0000 | 61 | 284 |
| Example 284 | 121 | 11.5 | 4.3 | 28 | Co | 0.2000 | — | 0.0000 | 65 | 286 |
| Example 285 | 122 | 11.4 | 5.5 | 22 | Co | 0.5000 | — | 0.0000 | 63 | 283 |
| Example 286 | 116 | 10.5 | 5.0 | 23 | Co | 0.7000 | — | 0.0000 | 57 | 279 |
| Example 287 | 117 | 10.3 | 4.3 | 27 | Ni | 0.2000 | — | 0.0000 | 64 | 288 |
| Example 288 | 127 | 12.8 | 6.0 | 21 | Ni | 0.5000 | — | 0.0000 | 59 | 285 |
| Example 289 | 119 | 10.6 | 4.8 | 25 | Ni | 0.7000 | — | 0.0000 | 54 | 282 |
| Example 290 | 108 | 10.2 | 4.7 | 23 | — | 0.0000 | Al | 0.0200 | 64 | 287 |
| Example 291 | 114 | 9.8 | 5.4 | 21 | — | 0.0000 | Al | 0.0400 | 60 | 284 |
| Example 292 | 118 | 10.3 | 5.4 | 22 | — | 0.0000 | Al | 0.0600 | 56 | 280 |
| Example 293 | 109 | 9.2 | 3.9 | 28 | — | 0.0000 | Zn | 0.0200 | 65 | 285 |
| Example 294 | 117 | 10.7 | 5.3 | 22 | — | 0.0000 | Zn | 0.0400 | 62 | 283 |
| Example 295 | 123 | 11.2 | 4.9 | 25 | — | 0.0000 | Zn | 0.0600 | 58 | 279 |
| Example 296 | 124 | 10.3 | 5.0 | 25 | — | 0.0000 | Sn | 0.0200 | 63 | 286 |
| Example 297 | 117 | 10.8 | 5.6 | 21 | — | 0.0000 | Sn | 0.0400 | 61 | 282 |
| Example 298 | 123 | 11.2 | 4.7 | 26 | — | 0.0000 | Sn | 0.0600 | 56 | 278 |
| Example 299 | 122 | 12.3 | 5.3 | 23 | — | 0.0000 | Cu | 0.0200 | 62 | 286 |
| Example 300 | 115 | 10.8 | 4.3 | 27 | — | 0.0000 | Cu | 0.0400 | 61 | 285 |
| Example 301 | 116 | 10.4 | 4.1 | 28 | — | 0.0000 | Cu | 0.0600 | 57 | 281 |
| Example 302 | 113 | 11.2 | 4.9 | 23 | — | 0.0000 | Cr | 0.0200 | 63 | 286 |
| Example 303 | 122 | 12.7 | 5.1 | 24 | — | 0.0000 | Cr | 0.0400 | 61 | 284 |
| Example 304 | 121 | 11.4 | 5.8 | 21 | — | 0.0000 | Cr | 0.0600 | 57 | 279 |
| Example 305 | 107 | 10.6 | 4.1 | 26 | — | 0.0000 | Bi | 0.0200 | 63 | 284 |
| Example 306 | 113 | 10.1 | 5.1 | 22 | — | 0.0000 | Bi | 0.0400 | 62 | 284 |

TABLE 25-continued

| | Coating part | | | | $(Fe_{(1-(\alpha+\beta))}X1_{\alpha}X2_{\beta})_{0.750}B_{0.150}Si_{0.100}$ | | | | Dust core | |
|---|---|---|---|---|---|---|---|---|---|---|
| | Rz (nm) | Ra (nm) | Rz/T | Thickness T (nm) | X1 (atomic number ratio) Element | 0.750 × α | X2 (atomic number ratio) Element | 0.750 × β | Strength (MPa) | Withstand voltage (V/mmm) |
| Example 307 | 120 | 11.7 | 4.8 | 25 | — | 0.0000 | Bi | 0.0600 | 57 | 280 |
| Example 308 | 117 | 9.8 | 4.5 | 26 | — | 0.0000 | La | 0.0200 | 62 | 285 |
| Example 309 | 121 | 12.9 | 5.8 | 21 | — | 0.0000 | La | 0.0400 | 62 | 284 |
| Example 310 | 118 | 11.5 | 5.1 | 23 | — | 0.0000 | La | 0.0600 | 59 | 278 |
| Example 311 | 122 | 10.1 | 4.4 | 28 | — | 0.0000 | Y | 0.0200 | 62 | 284 |
| Example 312 | 115 | 12.5 | 5.2 | 22 | — | 0.0000 | Y | 0.0400 | 61 | 283 |
| Example 313 | 118 | 10.3 | 4.9 | 24 | — | 0.0000 | Y | 0.0600 | 57 | 278 |
| Example 314 | 124 | 13.5 | 5.0 | 25 | — | 0.0000 | O | 0.0200 | 63 | 285 |
| Example 315 | 112 | 9.7 | 4.1 | 27 | — | 0.0000 | O | 0.0400 | 62 | 284 |
| Example 316 | 119 | 11.7 | 5.7 | 21 | — | 0.0000 | O | 0.0600 | 59 | 281 |

Experiment 12

A soft magnetic metal powder was manufactured by the same method as in Example 38 of Experiment 2 except that the composition of the soft magnetic metal was set to compositions shown in Tables 26 to 28, and the same evaluation as in Experiment 2 was performed. In addition, a dust core was manufactured by the same method as in Experiment 1 by using the obtained powder, and the same evaluation as in Experiment 1 was performed. The results are shown in Tables 26 to 29. Note that, in Examples 317 to 382, the soft magnetic metal was a nanocrystalline alloy, and the average crystal grain size of the nanocrystal was 5 to 30 nm. In addition, the material of the powder-shaped coating material was the same as in Example 38.

TABLE 26

| | Coating part | | | | | | | | | | | Dust core | |
|---|---|---|---|---|---|---|---|---|---|---|---|---|---|
| | | | | Thickness | $Fe_{(1-(a+b+c+d+e+f))}M_aB_bP_cSi_dC_eS_f$ (α = β = 0) | | | | | | | | Withstand |
| | Rz (nm) | Ra (nm) | Rz/T | T (nm) | Fe | M(Nb) a | B b | P c | Si d | C e | S f | Strength (MPa) | voltage (V/mm) |
| Example 317 | 116 | 11.7 | 4.3 | 27 | 0.870 | 0.000 | 0.080 | 0.030 | 0.020 | 0.000 | 0.0000 | 65 | 289 |
| Example 318 | 123 | 11.1 | 4.4 | 28 | 0.770 | 0.100 | 0.080 | 0.030 | 0.020 | 0.000 | 0.0000 | 68 | 294 |
| Example 319 | 105 | 9.8 | 4.4 | 24 | 0.670 | 0.200 | 0.080 | 0.030 | 0.020 | 0.000 | 0.0000 | 64 | 286 |
| Example 320 | 111 | 11.9 | 4.3 | 26 | 0.570 | 0.300 | 0.080 | 0.030 | 0.020 | 0.000 | 0.0000 | 61 | 283 |
| Example 321 | 129 | 12.7 | 6.1 | 21 | 0.890 | 0.060 | 0.000 | 0.030 | 0.020 | 0.000 | 0.0000 | 67 | 290 |
| Example 322 | 112 | 10.9 | 4.1 | 27 | 0.690 | 0.060 | 0.200 | 0.030 | 0.020 | 0.000 | 0.0000 | 68 | 293 |
| Example 323 | 129 | 13.1 | 5.9 | 22 | 0.590 | 0.060 | 0.300 | 0.030 | 0.020 | 0.000 | 0.0000 | 65 | 287 |
| Example 324 | 108 | 10.1 | 3.9 | 28 | 0.490 | 0.060 | 0.400 | 0.030 | 0.020 | 0.000 | 0.0000 | 59 | 283 |
| Example 325 | 115 | 11.2 | 4.4 | 26 | 0.840 | 0.060 | 0.080 | 0.000 | 0.020 | 0.000 | 0.0000 | 64 | 287 |
| Example 326 | 113 | 12.2 | 5.4 | 21 | 0.640 | 0.060 | 0.080 | 0.200 | 0.020 | 0.000 | 0.0000 | 65 | 289 |
| Example 327 | 105 | 9.6 | 4.2 | 25 | 0.540 | 0.060 | 0.080 | 0.300 | 0.020 | 0.000 | 0.0000 | 63 | 284 |
| Example 328 | 102 | 10.4 | 4.4 | 23 | 0.440 | 0.060 | 0.080 | 0.400 | 0.020 | 0.000 | 0.0000 | 58 | 280 |
| Example 329 | 108 | 11.6 | 4.2 | 26 | 0.830 | 0.060 | 0.080 | 0.030 | 0.000 | 0.000 | 0.0000 | 64 | 286 |
| Example 330 | 119 | 12.2 | 4.4 | 27 | 0.630 | 0.060 | 0.080 | 0.030 | 0.200 | 0.000 | 0.0000 | 66 | 287 |
| Example 331 | 103 | 10.3 | 4.9 | 21 | 0.530 | 0.060 | 0.080 | 0.030 | 0.300 | 0.000 | 0.0000 | 63 | 284 |
| Example 332 | 116 | 12.1 | 5.3 | 22 | 0.430 | 0.060 | 0.080 | 0.030 | 0.400 | 0.000 | 0.0000 | 60 | 279 |
| Example 333 | 115 | 10.9 | 4.1 | 28 | 0.810 | 0.060 | 0.080 | 0.030 | 0.020 | 0.000 | 0.0000 | 62 | 286 |
| Example 334 | 121 | 12.3 | 5.3 | 23 | 0.610 | 0.060 | 0.080 | 0.030 | 0.020 | 0.200 | 0.0000 | 63 | 288 |
| Example 335 | 118 | 11.5 | 4.5 | 26 | 0.510 | 0.060 | 0.080 | 0.030 | 0.020 | 0.300 | 0.0000 | 61 | 285 |
| Example 336 | 119 | 11.3 | 5.0 | 24 | 0.410 | 0.060 | 0.080 | 0.030 | 0.020 | 0.400 | 0.0000 | 56 | 281 |
| Example 337 | 110 | 10.6 | 5.2 | 21 | 0.810 | 0.060 | 0.080 | 0.030 | 0.020 | 0.000 | 0.0000 | 64 | 287 |
| Example 338 | 121 | 11.9 | 4.5 | 27 | 0.790 | 0.060 | 0.080 | 0.030 | 0.020 | 0.000 | 0.0200 | 65 | 289 |
| Example 339 | 122 | 12.7 | 5.8 | 21 | 0.780 | 0.060 | 0.080 | 0.030 | 0.020 | 0.000 | 0.0300 | 62 | 284 |
| Example 340 | 114 | 10.4 | 4.6 | 25 | 0.770 | 0.060 | 0.080 | 0.030 | 0.020 | 0.000 | 0.0400 | 56 | 277 |

TABLE 27

| | Coating part | | | | | Dust core | |
|---|---|---|---|---|---|---|---|
| | Rz (nm) | Ra (nm) | Rz/T | Thickness T (nm) | $Fe_{0.810}M_{0.060}B_{0.080}P_{0.050}$ M | Strength (MPa) | Withstand voltage (V/mm) |
| Example 341 | 104 | 10.5 | 3.7 | 28 | Nb | 64 | 286 |
| Example 342 | 111 | 10.3 | 4.4 | 25 | Hf | 63 | 284 |
| Example 343 | 117 | 12.3 | 4.0 | 29 | Zr | 63 | 285 |

TABLE 27-continued

| | Coating part | | | | | Dust core | |
|---|---|---|---|---|---|---|---|
| | Rz (nm) | Ra (nm) | Rz/T | Thickness T (nm) | $Fe_{0.810}M_{0.060}B_{0.080}P_{0.050}$ M | Strength (MPa) | Withstand voltage (V/mm) |
| Example 344 | 102 | 9.4 | 4.6 | 22 | Ta | 65 | 284 |
| Example 345 | 119 | 10.9 | 5.7 | 21 | Mo | 63 | 286 |
| Example 346 | 116 | 11.5 | 4.3 | 27 | W | 62 | 282 |
| Example 347 | 117 | 10.8 | 4.5 | 26 | V | 63 | 283 |
| Example 348 | 127 | 12.8 | 5.8 | 22 | Ti | 65 | 284 |

TABLE 28

| | Coating part | | | | $(Fe_{(1-(\alpha+\beta)}X1_{\alpha}X2_{\beta})_{0.810}M_{0.070}B_{0.090}P_{0.030}$ | | | | Dust core | |
|---|---|---|---|---|---|---|---|---|---|---|
| | Rz (nm) | Ra (nm) | Rz/T | Thickness T (nm) | X1 (atomic number ratio) Element | X1 (atomic number ratio) $0.810 \times \alpha$ | X2 (atomic number ratio) Element | X2 (atomic number ratio) $0.810 \times \beta$ | Strength (MPa) | Withstand voltage (V/mm) |
| Example 349 | 109 | 10.8 | 4.2 | 26 | — | 0.0000 | — | 0.0000 | 62 | 286 |
| Example 350 | 114 | 10.9 | 4.2 | 27 | Co | 0.2000 | — | 0.0000 | 66 | 288 |
| Example 351 | 122 | 12.5 | 5.8 | 21 | Co | 0.5000 | — | 0.0000 | 64 | 287 |
| Example 352 | 119 | 9.1 | 4.3 | 28 | Co | 0.7000 | — | 0.0000 | 58 | 284 |
| Example 353 | 115 | 12.1 | 5.0 | 23 | Ni | 0.2000 | — | 0.0000 | 65 | 290 |
| Example 354 | 121 | 11.7 | 4.3 | 28 | Ni | 0.5000 | — | 0.0000 | 63 | 288 |
| Example 355 | 109 | 8.9 | 4.5 | 24 | Ni | 0.7000 | — | 0.0000 | 57 | 285 |
| Example 356 | 114 | 11.3 | 4.4 | 26 | — | 0.0000 | Al | 0.0200 | 66 | 289 |
| Example 357 | 120 | 12.5 | 5.5 | 22 | — | 0.0000 | Al | 0.0400 | 62 | 287 |
| Example 358 | 120 | 10.4 | 5.2 | 23 | — | 0.0000 | Al | 0.0600 | 58 | 283 |
| Example 359 | 110 | 11.7 | 5.2 | 21 | — | 0.0000 | Zn | 0.0200 | 67 | 288 |
| Example 360 | 125 | 17.1 | 6.3 | 20 | — | 0.0000 | Zn | 0.0400 | 65 | 286 |
| Example 361 | 113 | 12.5 | 4.5 | 25 | — | 0.0000 | Zn | 0.0600 | 60 | 282 |
| Example 362 | 102 | 7.9 | 3.8 | 27 | — | 0.0000 | Sn | 0.0200 | 65 | 287 |
| Example 363 | 119 | 13.6 | 5.7 | 21 | — | 0.0000 | Sn | 0.0400 | 63 | 285 |
| Example 364 | 114 | 10.0 | 4.4 | 26 | — | 0.0000 | Sn | 0.0600 | 58 | 282 |
| Example 365 | 126 | 11.1 | 5.3 | 24 | — | 0.0000 | Cu | 0.0200 | 64 | 289 |
| Example 366 | 112 | 12.2 | 4.0 | 28 | — | 0.0000 | Cu | 0.0400 | 62 | 287 |
| Example 367 | 115 | 17.9 | 5.8 | 20 | — | 0.0000 | Cu | 0.0600 | 60 | 283 |
| Example 368 | 105 | 7.8 | 5.0 | 21 | — | 0.0000 | Cr | 0.0200 | 65 | 292 |
| Example 369 | 99 | 7.4 | 4.7 | 21 | — | 0.0000 | Cr | 0.0400 | 63 | 291 |
| Example 370 | 115 | 12.9 | 4.4 | 26 | — | 0.0000 | Cr | 0.0600 | 60 | 287 |
| Example 371 | 113 | 10.6 | 4.9 | 23 | — | 0.0000 | Bi | 0.0200 | 63 | 287 |
| Example 372 | 115 | 15.3 | 4.4 | 26 | — | 0.0000 | Bi | 0.0400 | 62 | 285 |
| Example 373 | 128 | 10.5 | 6.1 | 21 | — | 0.0000 | Bi | 0.0600 | 59 | 281 |
| Example 374 | 110 | 12.4 | 4.8 | 23 | — | 0.0000 | La | 0.0200 | 62 | 287 |
| Example 375 | 114 | 12.1 | 4.1 | 28 | — | 0.0000 | La | 0.0400 | 61 | 285 |
| Example 376 | 125 | 13.3 | 5.0 | 25 | — | 0.0000 | La | 0.0600 | 59 | 282 |
| Example 377 | 117 | 10.9 | 4.3 | 27 | — | 0.0000 | Y | 0.0200 | 63 | 286 |
| Example 378 | 102 | 12.6 | 4.9 | 21 | — | 0.0000 | Y | 0.0400 | 62 | 285 |
| Example 379 | 112 | 10.1 | 4.3 | 26 | — | 0.0000 | Y | 0.0600 | 60 | 283 |
| Example 380 | 120 | 12.5 | 4.8 | 25 | — | 0.0000 | O | 0.0200 | 65 | 293 |
| Example 381 | 122 | 12.2 | 4.5 | 27 | — | 0.0000 | O | 0.0400 | 64 | 291 |
| Example 382 | 113 | 9.7 | 5.7 | 20 | — | 0.0000 | O | 0.0600 | 61 | 285 |

From Tables 24 to 28, in addition to a case where the line roughness was within the above-described range, in a case where the composition of the soft magnetic metal was within the above-described range, it could be confirmed that both the strength and the withstand voltage property of the dust core were compatible at a high level.

Experiment 13

A soft magnetic metal powder was manufactured by the same method as in Example 1 of Experiment 1, and the surface roughness (Sz and Sa) and the line roughness (Rz and Ra) were calculated with respect to the soft magnetic metal particles on which the coating part was formed by using the same measurement device as in Experiment 1 and Experiment 2 under the same measurement conditions. In addition, a dust core was manufactured by the same method as in Experiment 1 by using the obtained powder, and the same evaluation as in Experiment 1 was performed. The results are shown in Table 29.

TABLE 29

| | Coating part | | | | | | | | Soft | Dust core | |
|---|---|---|---|---|---|---|---|---|---|---|---|
| | Sz (nm) | Sa (nm) | Sz/T | Rz (nm) | Ra (nm) | Rz/T | Thickness T (nm) | Material | magnetic metal Structure | Strength (MPa) | Withstand voltage (V/mm) |
| Example 383 | 25 | 1.9 | 1.1 | 18 | 2.8 | 0.8 | 22 | $P_2O_5$—ZnO—$R_2O$—$Al_2O_3$ | Nanocrystal | 28 | 291 |
| Example 384 | 46 | 3.2 | 2.0 | 32 | 4.6 | 1.4 | 23 | $P_2O_5$—ZnO—$R_2O$—$Al_2O_3$ | Nanocrystal | 41 | 287 |
| Example 385 | 93 | 8.6 | 3.7 | 72 | 9.3 | 2.9 | 25 | $P_2O_5$—ZnO—$R_2O$—$Al_2O_3$ | Nanocrystal | 48 | 285 |
| Example 386 | 115 | 12 | 4.8 | 82 | 11 | 3.4 | 24 | $P_2O_5$—ZnO—$R_2O$—$Al_2O_3$ | Nanocrystal | 49 | 284 |
| Example 387 | 162 | 15 | 5.8 | 123 | 15 | 4.4 | 28 | $P_2O_5$—ZnO—$R_2O$—$Al_2O_3$ | Nanocrystal | 52 | 278 |
| Example 388 | 271 | 21 | 10.8 | 189 | 23 | 7.6 | 25 | $P_2O_5$—ZnO—$R_2O$—$Al_2O_3$ | Nanocrystal | 53 | 271 |
| Example 389 | 364 | 28 | 15.8 | 272 | 37 | 11.8 | 23 | $P_2O_5$—ZnO—$R_2O$—$Al_2O_3$ | Nanocrystal | 56 | 254 |
| Example 390 | 478 | 41 | 17.7 | 378 | 42 | 14.0 | 27 | $P_2O_5$—ZnO—$R_2O$—$Al_2O_3$ | Nanocrystal | 57 | 236 |
| Example 391 | 567 | 47 | 23.6 | 471 | 58 | 19.6 | 24 | $P_2O_5$—ZnO—$R_2O$—$Al_2O_3$ | Nanocrystal | 60 | 213 |
| Example 392 | 682 | 59 | 29.7 | 592 | 76 | 25.7 | 23 | $P_2O_5$—ZnO—$R_2O$—$Al_2O_3$ | Nanocrystal | 62 | 164 |

From Table 29, it could be confirmed that the surface roughness and the line roughness correspond to each other, and it could be confirmed that in a case where the line roughness was within the above-described range and in a case where the surface roughness was within the above-described range, the strength and the withstand voltage property of the dust core were compatible with each other.

Experiment 14

A soft magnetic metal powder was manufactured by the same method as in Example 1 of Experiment 1 except that the coating ratio of the coated particles was set to values shown in Table 30, and the same evaluation as in Experiment 1 was performed. In addition, a dust core was manufactured by the same method as in Experiment 1 by using the obtained powder, and the same evaluation as in Experiment 1 was performed. The results are shown in Table 30.

Moreover, a soft magnetic metal powder was manufactured by the same method as in Example 38 of Experiment 2 except that the coating ratio of the coated particles was set to values shown in Table 31, and the same evaluation as in Experiment 2 was performed. In addition, a dust core was manufactured by the same method as in Experiment 1 by using the obtained powder, and the same evaluation as in Experiment 1 was performed. The results are shown in Table 31.

Note that, the coating ratio was measured as follows. The coating ratio was measured as follows with respect to the soft magnetic metal particles on which the coating part was formed. As a measurement device, a scanning electron microscope (SU5000, manufactured by Hitachi High-Tech Science Corporation) was used. An observation mode of the scanning electron microscope was set to compositions image, and a square region of 100 μm×100 μm was selected, and the composition image of the region was obtained. Acquisition of the composition image was performed with respect to 10 locations. The obtained composition image was binarized by using commercially available image analysis software so that the coating part was shown in a black color and a region in which an uncoated metal was exposed was shown in a white color, and then a ratio of an area of the coating part with respect to a total area of the particle was set as the coating ratio.

TABLE 30

| | Coating part | | | | | Soft | Coated particle | Dust core | |
|---|---|---|---|---|---|---|---|---|---|
| | Sz (nm) | Sa (nm) | Sz/T | Thickness T (nm) | Material | magnetic metal Structure | Coating ratio (%) | Strength (MPa) | Withstand voltage (V/mm) |
| Example 393 | 94 | 8.7 | 3.9 | 24 | $P_2O_5$—ZnO—$R_2O$—$Al_2O_3$ | Nanocrystal | 90 | 48 | 257 |
| Example 394 | 91 | 8.5 | 3.5 | 26 | $P_2O_5$—ZnO—$R_2O$—$Al_2O_3$ | Nanocrystal | 80 | 44 | 234 |
| Example 395 | 95 | 9.2 | 4.1 | 23 | $P_2O_5$—ZnO—$R_2O$—$Al_2O_3$ | Nanocrystal | 70 | 39 | 211 |

TABLE 31

| | Coating part | | | | | Soft | Coated particle | Dust core | |
|---|---|---|---|---|---|---|---|---|---|
| | Rz (nm) | Ra (nm) | Rz/T | Thickness T (nm) | Material | magnetic metal Structure | Coating ratio (%) | Strength (MPa) | Withstand voltage (V/mm) |
| Example 396 | 95 | 8.9 | 3.7 | 26 | $P_2O_5$—ZnO—$R_2O$—$Al_2O_3$ | Nanocrystal | 90 | 47 | 255 |
| Example 397 | 97 | 9.3 | 4.2 | 23 | $P_2O_5$—ZnO—$R_2O$—$Al_2O_3$ | Nanocrystal | 80 | 43 | 229 |
| Example 398 | 93 | 8.7 | 3.7 | 25 | $P_2O_5$—ZnO—$R_2O$—$Al_2O_3$ | Nanocrystal | 70 | 38 | 208 |

From Table 30, in addition to a case where the surface roughness was within the above-described range, in a case where the coating ratio of the coated particle was within the above-described range, it could be confirmed that both the strength and the withstand voltage property of the dust core were compatible at a high level.

Moreover, from Table 31, in addition to a case where the line roughness was within the above-described range, in a case where the coating ratio of the coated particle was within the above-described range, it could be confirmed that both the strength and the withstand voltage property of the dust core were compatible with each other at a high level.

What is claimed is:

1. A soft magnetic metal powder comprising a plurality of soft magnetic metal particles containing iron, wherein a surface of each of the soft magnetic metal particles is covered with a coating part, and a maximum height Sz of a surface of the coating part is 10 to 700 nm.

2. The soft magnetic metal powder according to claim 1, wherein an arithmetical mean height Sa of the surface of the coating part is 3 to 50 nm.

3. The soft magnetic metal powder according to claim 1, wherein Sz/T is 1.5 to 30, in which a thickness of the coating part is set as T [nm].

4. A soft magnetic metal powder comprising a plurality of soft magnetic metal particles containing iron, wherein a surface of each of the soft magnetic metal particles is covered with a coating part, and a maximum height Rz of a surface of the coating part is 10 to 700 nm.

5. The soft magnetic metal powder according to claim 4, wherein an arithmetical mean height Ra of the surface of the coating part is 3 to 100 nm.

6. The soft magnetic metal powder according to claim 4, wherein Rz/T is 1.5 to 30, in which a thickness of the coating part is set as T [nm].

7. The soft magnetic metal powder according to claim 1, wherein T is 3 to 200 nm, in which a thickness of the coating part is set as T [nm].

8. The soft magnetic metal powder according to claim 4, wherein T is 3 to 200 nm, in which a thickness of the coating part is set as T [nm].

9. The soft magnetic metal powder according to claim 1, wherein the coating part contains at least one selected from the group consisting of phosphorus, aluminum, calcium, barium, bismuth, silicon, chromium, sodium, zinc, and oxygen.

10. The soft magnetic metal powder according to claim 4, wherein the coating part contains at least one selected from the group consisting of phosphorus, aluminum, calcium, barium, bismuth, silicon, chromium, sodium, zinc, and oxygen.

11. The soft magnetic metal powder according to claim 1, wherein the soft magnetic metal particles are constituted by an amorphous alloy.

12. The soft magnetic metal powder according to claim 4, wherein the soft magnetic metal particles are constituted by an amorphous alloy.

13. The soft magnetic metal powder according to claim 1, wherein the soft magnetic metal particles are constituted by a nanocrystalline alloy.

14. The soft magnetic metal powder according to claim 4, wherein the soft magnetic metal particles are constituted by a nanocrystalline alloy.

15. A dust core containing:

the soft magnetic metal powder according to claim 1.

16. A dust core containing:

the soft magnetic metal powder according to claim 4.

17. A magnetic component comprising:

the dust core according to claim 15.

18. A magnetic component comprising:

the dust core according to claim 16.

* * * * *